US008050609B2

(12) United States Patent
Kobayashi et al.

(10) Patent No.: US 8,050,609 B2
(45) Date of Patent: Nov. 1, 2011

(54) FIXING DEVICE AND IMAGE FORMING APPARATUS

(75) Inventors: Yoshiyuki Kobayashi, Yamatokoriyama (JP); Masaharu Kimura, Daito (JP); Yasuaki Fukada, Nara (JP); Masahiko Fujita, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 335 days.

(21) Appl. No.: 12/372,004

(22) Filed: Feb. 17, 2009

(65) Prior Publication Data

US 2009/0208261 A1 Aug. 20, 2009

(30) Foreign Application Priority Data

Feb. 18, 2008 (JP) ..... 2008-036717

(51) Int. Cl.
*G03G 15/20* (2006.01)

(52) U.S. Cl. ..... 399/328

(58) Field of Classification Search ..... 399/328, 399/330, 67, 68, 322, 331, 339; 347/156, 347/212

See application file for complete search history.

(56) References Cited

U.S. PATENT DOCUMENTS

| | | | | |
|---|---|---|---|---|
| 4,389,114 | A * | 6/1983 | Westerman | 399/339 |
| 5,541,636 | A * | 7/1996 | Ingram | 347/212 |
| 5,999,789 | A * | 12/1999 | Sawamura | 399/330 |
| 2005/0129433 | A1 | 6/2005 | Jaskowiak et al. | |
| 2009/0129836 | A1 | 5/2009 | Sakaya et al. | |

FOREIGN PATENT DOCUMENTS

| | | |
|---|---|---|
| CN | 1629748 A | 6/2005 |
| JP | 62-18584 | 1/1987 |
| JP | 4-178675 | 6/1992 |
| JP | 06-014524 | 1/1994 |
| JP | 08-160793 | 6/1996 |
| JP | 09-286529 | 11/1997 |
| JP | 2000-137400 | 5/2000 |
| JP | 2006-010758 | 1/2006 |
| JP | 2007-183682 | 7/2007 |
| JP | 2009-122563 | 6/2009 |

* cited by examiner

*Primary Examiner* — David Porta
*Assistant Examiner* — Faye Boosalis
(74) *Attorney, Agent, or Firm* — Renner, Otto, Boisselle & Sklar, LLP

(57) ABSTRACT

In a fixing device, a heat roller and a fixing gear for rotating the heat roller are arranged concentrically, and coupled to each other by inserting a key formed in the fixing gear into a keyway formed in the heat roller. The keyway is designed such that the key is allowed to move along a direction in which the heat roller is rotated. For example, the keyway is formed by notching a free end of a one-side rotary shaft of the heat roller so as to extend along the direction in which the heat roller is rotated.

7 Claims, 17 Drawing Sheets

FIXING DEVICE AND IMAGE FORMING APPARATUS

CROSS-REFERENCE TO RELATED APPLICATION

This application claims priority to Japanese Patent Application No. 2008-036717, which was filed on Feb. 18, 2008, the contents of which are incorporated herein by reference in its entirety.

BACKGROUND OF THE INVENTION

1. Field of the Invention

The present invention relates to a fixing device for fixing a toner image formed on a recording sheet, onto the recording sheet, as well as to an image forming apparatus having the fixing device.

2. Description of the Related Art

An electrophotographic image forming apparatus for forming images by means of electrophotography, such as a copying machine and a printer, is provided with a fixing device. As the fixing device, as shown in FIG. 2 for explaining the invention which will hereafter be described, there is known a fixing device 7 having a heat roller 71 which is heated by a heating portion and a pressure roller 72 which is brought into contact with the heat roller 71 under a predetermined contact pressure. In the fixing device 7, a recording sheet, for example, recording paper 202, having a yet-to-be heated developer e.g. toner transferred to its surface 202*a* which served as an image surface in a transfer device at a preceding step and is now going to face the heat roller 71, is fed between the heat roller 71 and the pressure roller 72 so that the yet-to-be heated developer is fixed onto the recording sheet 202.

In order to convey the recording sheet 202, the fixing device 7 has a post-fixing roller 75 and a post-fixing driven roller element 76 which rotates depending on the rotation of the post-fixing roller 75, that are located posteriorly of the heat roller 71 in a direction P in which the recording sheet 202 is conveyed; that is, located downstream of the heat roller 71 in a conveyance direction P. As the post-fixing roller 75 is rotated, with the recording medium 202 caught in the space between the post-fixing roller 75 and the post-fixing driven roller element 76, these rollers convey the recording sheet 202.

FIG. 13 is an exploded perspective view showing a heat roller 300 in a disassembled state, which is provided in a fixing device 400 according to a related art, and FIG. 14 is a side view of the heat roller 300, as viewed from one side in an axial direction thereof. In FIG. 14, a one-side rotary shaft 302 is illustrated by cross-hatching. The one-side rotary shaft 302 is a rotary shaft which extends in one axial direction from a roller main body 301 of the heat roller 300. In the heat roller 300, a key 311 formed in a fixing gear 310 fitted to a keyway 303 formed in the one-side rotary shaft 302, whereby the fixing gear 310 and the roller main body 301 are coupled to each other and are thus allowed to rotate together. The keyway 303 is so formed as to prevent the key 311 from moving along a direction in which the heat roller 300 is rotated. To be specific, the keyway 303 extends linearly in the axial direction and is substantially the same in size as the key 311 when viewed along the rotation direction of the heat roller 300.

FIG. 15 is a view for explaining a transmission mechanism of a driving force toward the heat roller 300 and the post-fixing roller in accordance with the related art. The heat roller 300 and the post-fixing roller are driven to rotate by a driving section 321. In order to rotate the heat roller 300 and the post-fixing roller, the driving section 321 uses a motor (not shown) to rotate a paper discharge roller-side gear 320 which is engaging with the fixing gear 310, thus causing the fixing gear 310 to rotate. The driving force exerted by the motor is transmitted in a direction indicated by an arrow B from the paper discharge roller-side gear 320 to the fixing gear 310 through which the driving force is transmitted in a direction indicated by an arrow C to the heat roller 300. The post-fixing roller is rotated under the driving force transmitted from the fixing gear 310, through a first coupling gear 322 and a second coupling gear 323, to a post-fixing roller driving gear 324.

As shown in FIG. 2 which will hereafter be explained, the heat roller and the pressure roller are each constructed of an elastic roller. Therefore, in a case where the recording sheet 202 is of the type that has a certain degree of thickness, such as gloss paper or heavy paper, upon passing of the recording sheet 202 through a nip region 203, the heat roller and the pressure roller undergo elastic deformation owing to the recording sheet 202, in consequence whereof there results a buildup of elastic energy in both of the rollers. The elastic energy is released when the recording sheet 202 comes out of the nip region 203, thus causing speeding up of the heat roller and the pressure roller. The resultant accelerated rotation of the heat roller reverses the transmission direction of the driving force exerted by the motor.

FIG. 16 is a view for explaining a mechanism for reversing a direction of power transmission. As shown in FIG. 16, the accelerated heat roller 300 applies a force to the key 311 of the fixing gear 310, which reverses the transmission direction so that the driving force is transmitted in a direction indicated by an arrow D from the one-side rotary shaft 302 of the heat roller 300 to the fixing gear 310. This causes momentary acceleration of the rotating fixing gear 310, with the result that the driving fore is transmitted in a direction indicated by an arrow E from the fixing gear 310 to the paper discharge roller-side gear 320. The paper discharge roller-side gear 320 is driven to rotate by the motor and configured to transmit the driving force in a direction opposite to the direction of the arrow E. The reversing of the transmission direction as above will therefore cause so-called tooth jumping between the fixing gear 310 and the paper discharge-roller side gear 320.

Upon the re-engagement between the fixing gear 310 and the paper discharge roller-side gear 320, the recording sheet is returned to a normally conveyed state where the tooth jumping has not occurred as yet. However, as shown in FIG. 6 for explaining the invention which will hereafter be described, until such time that the fixing gear 310 and the paper discharge roller-side gear 320 engage with each other, the recoding sheet is standing still, with its downstream-side end in the conveyance direction (hereafter referred to as "tail end") kept at a position to which it is moved immediately after coming out of the nip region 203. During that time, inconveniently, the post-fixing driven roller element 76 kept in contact with the image surface 202*a* leaves some impressions on the image.

A technique to prevent jumping of gear teeth, although it is not related to fixing device development, is disclosed in Japanese Unexamined Patent Publication JP-A 9-286529 (1997). JP-A 9-286529 discloses a sheet feeding apparatus. In the sheet feeding apparatus disclosed in JP-A 9-286529, when a paper-feeding roller is put under a load which is greater than a predetermined level, the engagement between the paper-feeding roller and a driving shaft is released so that only the driving shaft is rotated, that is, the driving shaft is idled. This makes it possible to reduce the load applied to the driving gear and thereby prevent occurrence of tooth jumping in the driving gear.

If, in the fixing device, the driving shaft is idled to prevent occurrence of tooth jumping in the fixing gear corresponding to the driving gear as in the technique disclosed in JP-A 9-286529, the conveyance of the recording sheet will be brought to a stop. Therefore, just as in the case where the tooth jumping occurs, the post-fixing driven roller element leaves some impressions on the image surface. The technique disclosed in JP-A 9-286529 is thus not applicable to the fixing device.

SUMMARY OF THE INVENTION

An object of the invention is to provide a fixing device capable of preventing conveyance of a recording sheet from being impeded in the presence of variation in drive load on a fixing roller, as well as to provide an image forming apparatus having the fixing device.

The invention provides a fixing device for fixing a toner image formed on a recording sheet, onto the recording sheet, comprising:

a fixing roller adapted to be rotatable about a predetermined axis of rotation;

a pressure roller disposed in pressure-contact with the fixing roller so as to be rotatable depending on a rotation of the fixing roller, the pressure roller holding and conveying a recording sheet on which a toner image is formed in cooperation with the fixing roller in a nip region where the pressure roller and the fixing roller abut against each other;

a fixing gear coupled to the fixing roller, for driving the fixing roller; and a driving section having a driving gear engageable with the fixing gear, for driving the fixing gear by rotating the driving gear, wherein the fixing roller and the fixing gear are arranged concentrically and coupled to each other by inserting a key formed in one of the fixing roller and the fixing gear into a keyway formed in the other of the fixing roller and the fixing gear, and the keyway is designed such that the key is allowed to move along a direction in which the fixing roller is rotated.

According to the invention, the driving gear is rotated by the driving section, which leads to rotation of the fixing gear in meshing engagement with the driving gear, thereby causing the fixing roller coupled to the fixing gear to rotate about the axis of rotation of the fixing roller itself. As the fixing roller is rotatably driven, the pressure roller kept in pressure-contact therewith is rotated depending on the rotation of the fixing roller. In the nip region where the fixing roller and the pressure roller abut against each other, the recording sheet on which a toner image is formed, is held and conveyed between the rollers, whereupon the toner image is fixed onto the recording sheet. The fixing roller and the fixing gear are arranged concentrically and coupled to each other by inserting the key formed in one of the fixing roller and the fixing gear into the keyway formed in the other of the fixing roller and the fixing gear. The keyway is so designed that the key can move along the direction in which the fixing roller is rotated, which enables the fixing roller and the fixing gear to be uncoupled from each other by moving the key along the direction in which the fixing roller is rotated. When drive load on the fixing roller is caused to vary due to the interaction between the nip region and the recording sheet, for example, when the fixing roller receives application of a force other than the driving force transmitted thereto from the driving section via the fixing gear, the fixing roller is accelerated while the key moves relative to the keyway along the direction in which the fixing roller is rotated, thereby uncoupling the fixing roller and the fixing gear. This makes it possible to prevent the application of a force from the fixing roller onto the fixing gear, and it is thereby possible to prevent the tooth jumping between the fixing gear and the driving gear. Accordingly, the conveyance of the recording sheet can be prevented from being impeded, which enables formation of images without quality deterioration. For example, in the case where a post-fixing driven roller element is disposed downstream of the nip region in a conveyance direction of the recording sheet, it is possible to protect the recording sheet from impressions made by the post-fixing driven roller element.

Further, in the invention, it is preferable that in a cross section of the keyway perpendicular to the axis of rotation of the fixing roller, a maximum possible angle $\alpha$ of displacement of the key relative to the keyway is equal to or greater than a nip angle $\theta 1$ on the nip region side, out of angles made by two line segments which are formed by connecting the axis of rotation of the fixing roller with one and the other of two intersections of the fixing roller and the recording sheet being in the passage through the nip region.

According to the invention, the keyway is designed such that in the cross section perpendicular to the axis of rotation of the fixing roller, the maximum possible angle $\alpha$ of displacement of the key relative to the keyway is equal to or greater than the nip angle $\theta 1$. As a result, if the fixing roller receives any force other than the driving force transmitted thereto from the fixing gear upon passing of the recording sheet through the nip region, the key is allowed to move relatively to the keyway along the direction in which the fixing roller is rotated, by the nip angle $\theta 1$ or larger angle displacement around the axis of rotation of the fixing roller, and it is therefore possible to more reliably prevent the fixing roller and the fixing gear from coming into contact with each other at a position to which the key has moved. It is thus possible to more reliably prevent the application of a force from the fixing roller onto the fixing gear and therefore possible to more reliably prevent the occurrence of the tooth jumping between the fixing gear and the driving gear.

Further, in the invention, it is preferable that a keyway portion defining the keyway, and the key are formed so as to each have a one-side contact region which is allowed to contact each other when the fixing roller rotates in a direction relative to the key, and the other-side contact region which is allowed to contact each other when the fixing roller rotates in the other direction relative to the key, and in the cross section of the keyway perpendicular to the axis of rotation of the fixing roller, a keyway width angle $\beta$ on the side including the keyway, out of angles made by a line segment which is formed by connecting the one-side contact region of the keyway portion with the axis of rotation of the fixing roller and a line segment which is formed by connecting the other-side contact region of the keyway portion with the axis of rotation of the fixing roller, is equal to or greater than a sum angle ($\theta 1+\theta 2$) consisting of a nip angle $\theta 1$ on the nip region side, out of the angles made by the two line segments which are formed by connecting the axis of rotation of the fixing roller with one and the other of the two intersections of the fixing roller and the recording sheet being in the passage through the nip region, plus a key width angle $\theta 2$ on the side including the key, out of angles made by a line segment which is formed by connecting the one-side contact region of the key with the axis of rotation of the fixing roller and a line segment which is formed by connecting the other-side contact region of the key with the axis of rotation of the fixing roller.

According to the invention, the keyway is designed so that in the cross section perpendicular to the axis of rotation of the fixing roller, the keyway width angle β is equal to or greater than the sum angle (θ1+θ2) consisting of the nip angle θ1 and the key width angle θ2. As a result, if the fixing roller receives any force other than the driving force transmitted thereto from the fixing gear upon passing of the recording sheet through the nip region, the key is allowed to move relatively to the keyway along the direction in which the fixing roller is rotated, by the nip angle θ1 or larger angle displacement around the axis of rotation of the fixing roller, and it is therefore possible to more reliably prevent the fixing roller and the fixing gear from coming into contact with each other at a position to which the key has moved. It is thus possible to more reliably prevent the application of a force from the fixing roller onto the fixing gear and therefore possible to more reliably prevent the occurrence of the tooth jumping between the fixing gear and the driving gear.

Further, in the invention, it is preferable that the key is formed in an inner peripheral surface of the fixing gear, and the keyway is formed in an one axial end of the fixing roller.

According to the invention, the key connecting the fixing gear with the fixing roller is formed in the inner peripheral surface of the fixing gear, and the keyway into which the key is inserted, is formed in the one axial end of the fixing roller. This makes it easy to form the key and the keyway that allows the key to move along the direction in which the fixing roller is rotated.

Further, in the invention, it is preferable that the keyway is formed by notching the one axial end of the fixing roller so as to extend along the direction in which the fixing roller is rotated.

According to the invention, the keyway is formed by notching the one axial end of the fixing roller so as to extend along the direction in which the fixing roller is rotated. This makes it easier to form the key and the keyway that allows the key to move along the direction in which the fixing roller is rotated.

Further, in the invention, it is preferable that the driving section has a coupling gear, and the driving gear is coupled to another roller via the coupling gear.

According to the invention, the driving gear is coupled to another roller via the coupling gear. The driving section is therefore capable of rotating both of the fixing roller and the other roller. Now that the driving section for rotating the other roller is capable of functioning also as a driving section for rotating the fixing roller, the structure of the fixing device can be simpler.

Further, in the invention, it is preferable that the recording sheet is heavy paper.

According to the invention, the heavy paper as the recording sheet is held and conveyed in the nip region where the fixing roller and the pressure roller abut against each other. The keyway into which is inserted the key for coupling the fixing roller and the fixing gear, is so designed that the key is allowed to move along the direction in which the fixing roller is rotated, with the result that if the fixing roller receives any force other than the driving force transmitted thereto from the fixing gear upon passing of the heavy paper through the nip region, the key will move relatively to the keyway along the direction in which the fixing roller is rotated, so that the fixing roller and the fixing gear will be uncoupled from each other. This makes it possible to prevent the application of the force from the fixing roller onto the fixing gear, and it is thereby possible to prevent the tooth jumping between the fixing gear and the driving gear. That is why the fixing device is favorable in the case where the recording sheet is the heavy paper.

Further, in the invention, it is preferable that the recording sheet is gloss paper.

According to the invention, the gloss paper as the recording sheet is held and conveyed in the nip region where the fixing roller and the pressure roller abut against each other. The keyway into which is inserted the key for coupling the fixing roller and the fixing gear, is so designed that the key is allowed to move along the direction in which the fixing roller is rotated, with the result that if the fixing roller receives any force other than the driving force transmitted thereto from the fixing gear upon passing of the gloss paper through the nip region, the key will move relatively to the keyway along the direction in which the fixing roller is rotated, so that the fixing roller and the fixing gear will be uncoupled from each other. This makes it possible to prevent the application of the force from the fixing roller onto the fixing gear, and it is thereby possible to prevent the tooth jumping between the fixing gear and the driving gear. That is why the fixing device is favorable in the case where the recording sheet is the gloss paper.

Further, the invention provides an image forming apparatus comprising:

a toner image forming section for forming a toner image on a recording sheet, and the fixing device mentioned above, for fixing the formed toner image onto the recording sheet.

According to the invention, the image forming apparatus includes the toner image forming section and the fixing device of the invention, and the toner image forming section forms the toner image on the recording image while the fixing device of the invention fixes the toner image onto the recording sheet. In the fixing device of the invention, as described above, the tooth jumping can be prevented between the paper discharge roller-side gear and the driving gear so that the conveyance of the recording sheet is not impeded, and therefore in the case, for example, where the post-fixing driven roller element is disposed downstream of the nip region in the conveyance direction of the recording sheet, it is possible to protect the recording sheet from impressions made by the post-fixing driven roller element. Accordingly, by constituting an image forming apparatus so as to include the fixing device of the invention, it is possible to provide the image forming apparatus which is capable of forming high-quality images without impressions made by rollers such as the post-fixing driven roller element.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
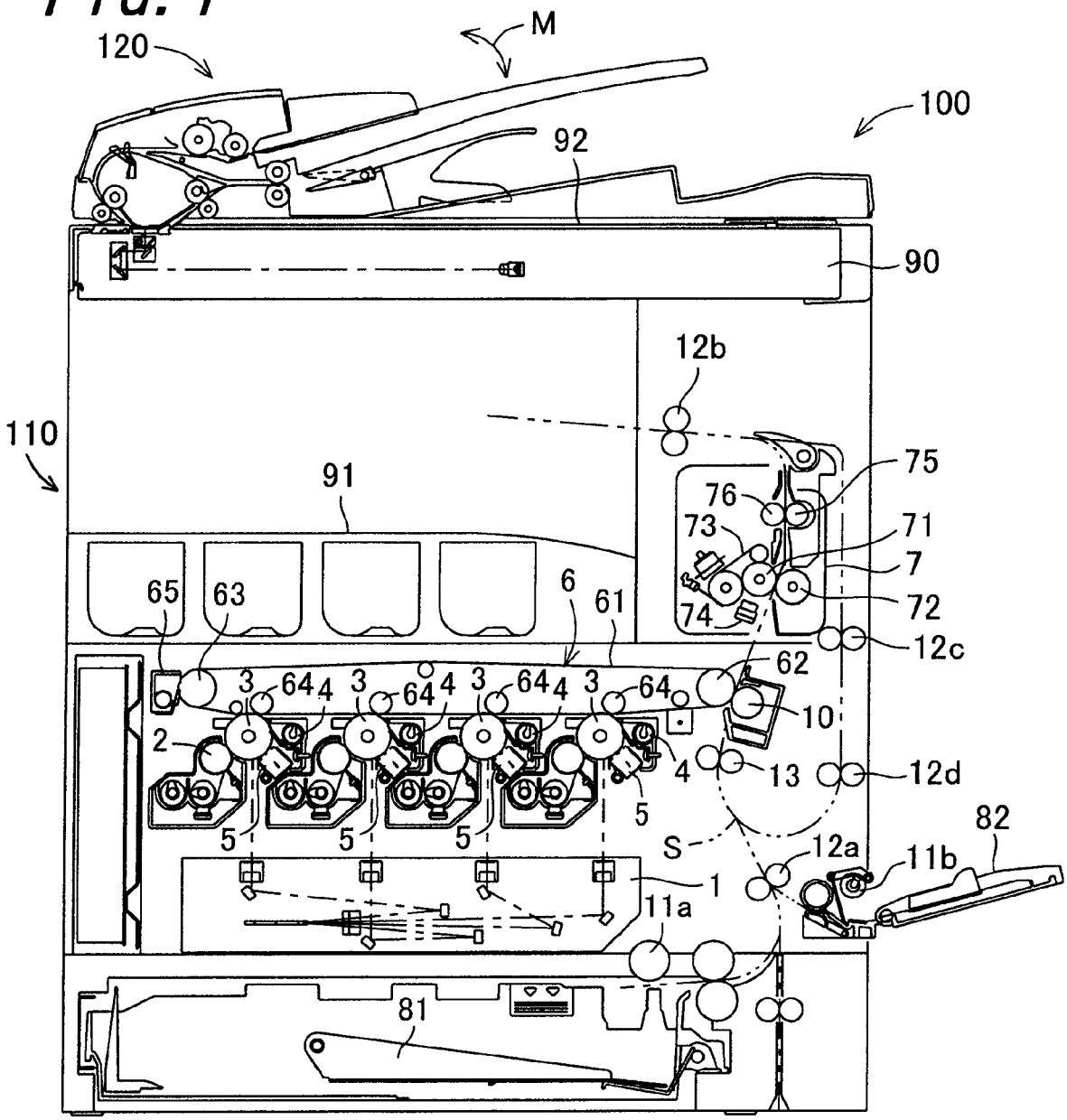
FIG. 1 is a schematic diagram showing a structure of an image forming apparatus having a fixing unit which is a fixing device according to one embodiment of the invention.

Now referring to the drawings, preferred embodiments of the invention are described below.

FIG. 1 is a schematic diagram showing the structure of an image forming apparatus 100 having a fixing unit 7 which is a fixing device according to one embodiment of the invention. The image forming apparatus 100 is designed to form multi-color or one-color images on a predetermined recording sheet, for example, a sheet-like recording medium such as recording paper in accordance with externally-transmitted image data. The image forming apparatus 100 includes an apparatus main body 110 and an automatic document processing device 120. The apparatus main body 110 includes an image reading section 90, an exposure unit 1, a developing device 2, a photoreceptor drum 3, a cleaner unit 4, a charging device 5, an intermediate transfer belt unit 6, a fixing unit 7, a paper-feeding cassette 81, a manual paper-feeding cassette 82, and a paper catch tray 91. The exposure unit 1, the developing device 2, the photoreceptor drum 3, the charging device 5, and the intermediate transfer belt unit 6 function as a toner image forming section.

With the image forming apparatus 100 placed on a horizontal plane, at the top of the apparatus main body 110 is disposed a document platen 92 made of a light-transmitting glass on which a document is placed. On the top side of the document platen 92 is mounted the automatic document processing device 120. The automatic document processing device 120 conveys a document onto the document platen 92 automatically. Moreover, since the automatic document processing device 120 is so designed as to be rotatable in a direction indicated by an arrow M, it follows that a user is able to place a document with his/her hands by leaving the top of the document platen 92 open.

Image data to be processed in the image forming apparatus 100 of this embodiment corresponds to a color image of black (K) color, cyan (C) color, magenta (M) color, and yellow (Y) color. In order to form latent images of the four colors on an individual basis, the developing device 2, the photoreceptor drum 3, the charging device 5, and the cleaner unit 4 are each correspondingly four in number to deal with black, cyan, magenta, and yellow, respectively. In this way, four units of image stations are made up.

The charging device 5 serves as a charging section for uniformly charging the surface of the photoreceptor drum 3 to a predetermined potential. While, in this embodiment, the charging device 5 is realized by using a charging device of non-contact charger type, instead of a charger-type charging device as shown in FIG. 1, a charging device of contact roller type or the one of contact brush type may be employed in another embodiment of the invention.

The exposure unit 1, which is an optical scanning device, to be more specific, an image writing device, is built as a laser scanning unit (LSU for short) having a laser emitting section, a reflection mirror, and so forth. In the exposure unit 1 are arranged a polygon mirror for scanning laser beams and optical elements such as a lens and a mirror for directing laser light reflected from the polygon mirror to the photoreceptor drum 3. In another embodiment of the invention, the exposure unit 1 may be built as a writing head comprising light-emitting elements e.g. electroluminescence (EL for short) elements or light-emitting diodes (LED for short) arranged in an array.

The exposure unit 1 has the function of exposing the photoreceptor drum 3 in a charged state to light in accordance with inputted image data to thereby form an electrostatic latent image corresponding to the image data on the surface of the photoreceptor drum 3. The developing device 2 turns the electrostatic latent images formed on their respective photoreceptor drums 3 into visual images by means of toners of four colors (YMCK). Moreover, the cleaner unit 4 removes and collects residual toner remaining on the surface of the photoreceptor drum 3 following the completion of development and image transfer process.

The intermediate transfer belt unit 6 located above the photoreceptor drums 3 comprises an intermediate transfer belt 61, an intermediate transfer belt driving roller 62, an intermediate transfer belt driven roller 63, an intermediate transfer roller 64, and an intermediate transfer belt cleaning unit 65. Four pieces of the intermediate transfer rollers 64 are provided to deal with the colors YMCK on an individual basis.

The intermediate transfer belt driving roller 62, the intermediate transfer belt driven roller 63, and the intermediate transfer rollers 64 allow the intermediate transfer belt 61 to be rotatably driven while being suspended in a tensioned state. Moreover, the intermediate transfer rollers 64 impart a transfer bias to transfer a toner image borne on the photoreceptor drum 3 onto the intermediate transfer belt 61.

The intermediate transfer belt 61 is disposed in contact with each of the photoreceptor drums 3. As for the function of the intermediate transfer belt 61, the toner images of four colors formed on the photoreceptor drums 3 are superimposedly transferred one after another onto the intermediate transfer belt 61, whereupon a color toner image (multi-color toner image) is formed on the intermediate transfer belt 61. For example, the intermediate transfer belt 61 is constructed of a film having a thickness of ca. 100 μm to 150 μm in an endless belt shape.

Transfer of toner images from the photoreceptor drum 3 to the intermediate transfer belt 61 is effected by the intermediate transfer roller 64 kept in contact with the reverse side of the intermediate transfer belt 61. The intermediate transfer roller 64 receives application of a high-voltage transfer bias for toner-image transfer, to be more specific, a high voltage of a polarity reverse to the polarity of charge on the toner. For example, if the polarity of charge on the toner is negative (−), a positive (+) high voltage is applied to the intermediate transfer roller 64. The intermediate transfer roller 64 is, for example, a roller constructed of a metal (e.g. stainless)-made shaft of 8 mm to 10 mm in diameter used as a base, the surface of which is covered with a conductive elastic material (such for example as EPDM and urethane foam). By virtue of the conductive elastic material, a high voltage can be uniformly impressed on the intermediate transfer belt 61. While, in this embodiment, a roller-shaped component is used as the transfer electrode, a brush-shaped component may be used instead.

As described above, the toner images obtained as the result of visualization of the electrostatic latent images on the photoreceptor drums 3 in accordance with the different colors are stacked on top of each other on the intermediate transfer belt 61. The thereby stacked, image data-based toner images are moved, as the intermediate transfer belt 61 is rotated, to a location where the recording sheet and the intermediate transfer belt 61 make contact with each other so as to be transferred onto the recording sheet by a transfer roller 10 disposed at the aforementioned contact location.

At this time, the intermediate transfer belt 61 and the transfer roller 10 are brought into pressure-contact with each other in a nip region having a predetermined dimension. Moreover, the transfer roller 10 receives application of a voltage for transferring the toner onto the recording sheet, to be more specific, a high voltage of a polarity reverse to the polarity of charge on the toner. For example, if the polarity of charge on the toner is negative (−), a positive (+) high voltage is applied to the transfer roller 10. Further, in order to obtain the nip region steadily, in constructing the transfer roller 10 and the intermediate transfer belt driving roller 62, one of them is made of a hard material (metal, etc.) and the other is made of a soft material such as an elastic roller element (elastic rubber roller, resin foam roller, etc.).

Furthermore, as described above, the toner that adhered to the intermediate transfer belt 61 upon contact with the photoreceptor drum 3, or the toner that remains on the intermediate transfer belt 61 due to the transfer roller 10 having not effected transfer on the paper sheet, is causative of mixing of toner colors in the subsequent process steps. Therefore, in this construction, the adherent/residual toner is removed and collected by the intermediate transfer belt cleaning unit 65. The intermediate transfer belt cleaning unit 65 is provided with a cleaning blade as a cleaning member which is brought into contact with the intermediate transfer belt 61. The intermediate transfer belt 61 contacted by the cleaning blade is supported, at its back side, by the intermediate transfer belt driven roller 63.

The paper-feeding cassette 81 is a tray on which recording sheets e.g. pieces of recording paper for use in image formation are piled up. In a state where the image forming apparatus 100 is placed on a horizontal plane, the paper-feeding cassette 81 is disposed below the exposure unit 1 of the apparatus main body 110. Moreover, recording sheets for use in image formation can be placed on the manual paper-feeding cassette 82, too. Further, the paper catch tray 91 disposed on the upper part of the apparatus main body 110 is a tray on which printed recording sheets, namely recording sheets having printed images are accumulated in a face-down manner; that is, the recording sheets are accumulated, with their toner image-bearing surfaces pointing downward.

In addition, in the apparatus main body 110 is provided a sheet conveyance path S in substantially vertical form for allowing the recording sheets placed on the paper-feeding cassette 81 as well as on the manual paper-feeding cassette 82 to be fed via the transfer roller 10 and the fixing unit 7 to the paper catch tray 91. In the vicinity of the sheet conveyance path S ranging from the paper-feeding cassette 81 or the manual paper-feeding cassette 82 to the paper catch tray 91, there are arranged pick-up rollers 11*a* and 11*b*, a plurality of conveying rollers 12*a* through 12*d*, a registration roller 13, the transfer roller 10, the fixing unit 7, and so forth.

The conveying rollers 12*a* through 12*d* are a plurality of compact rollers arranged along the sheet conveyance path S, for facilitating and assisting the conveyance of the recording sheets. Among the conveying rollers 12*a* through 12*d*, the paper discharge roller 12*b* is disposed downstream of the fixing unit 7 in a conveyance direction of the recording sheet and near the paper catch tray 91 and discharges thereto the recording sheet fed from the fixing unit 7. Moreover, the pick-up roller 11*a* is disposed in the vicinity of the end of the paper-feeding cassette 81, for picking up the recording sheets one by one from the paper-feeding cassette 81 and feeds them to the sheet conveyance path S. Likewise, the pick-up roller 11*b* is disposed in the vicinity of the end of the manual paper-feeding cassette 82, for picking up the recording sheets one by one from the manual paper-feeding cassette 82 and feeds them to the sheet conveyance path S.

Further, the registration roller 13 temporarily holds the recording sheet in the process of being conveyed along the sheet conveyance path S. The registration roller 13 has the capability of conveying the recording sheet to the transfer roller 10 in a timed relationship such that a leading end of the toner image borne on the photoreceptor drum 3 is aligned with a leading end of the recording sheet.

Thus, in the image forming apparatus 100 are disposed the paper-feeding cassette 81 for storing the recording sheets in advance and the manual paper-feeding cassette 82. In order to supply the recording sheets from these paper-feeding cassettes 81 and 82, the pick-up rollers 11*a* and 11*b* are arranged to direct the recording sheets one by one to the sheet conveyance path S.

The recording sheet conveyed from each of the paper-feeding cassettes 81 and 82 is conveyed by the conveying roller 12*a* on the sheet conveyance path S to the registration roller 13, and is then conveyed to the transfer roller 10 in a timed relationship such that the leading end of the recording sheet is aligned with the leading end of the image-data object borne on the intermediate transfer belt 61, whereupon the image data is committed onto the recording sheet. After that, during the passage of the recording sheet through the fixing unit 7, the yet-to-be fixed toner borne on the recording sheet is molten under application of heat and then fixed to the recording sheet, and eventually the recording sheet is discharged, through the paper discharge roller 12*b* located posteriorly of the fixing unit 7, onto the paper catch tray 91.

The sheet conveyance path is adapted for a print-job request of single-sided printing on the recording sheet. On the other hand, in order to deal with a print-job request of double-sided printing, after the single-sided printing is completed and the tail end of the recording sheet that has passed through the fixing unit 7 is caught hold of by the last paper discharge roller 12*b*, the paper discharge roller 12*b* is rotated in a reverse direction so as to direct the recording sheet to the conveying rollers 12*c* and 12*d*. Then, after the recording sheet passes through the registration roller 13 and the back side of the recording sheet is subjected to printing process, the recording sheet is discharged onto the paper catch tray 91.

The fixing unit 7 comprises the heat roller 71 acting as a fixing roller and the pressure roller 72. The heat roller 71 and the pressure roller 72 are rotated, with the recording sheet lying therebetween. Moreover, the heat roller 71 is so designed that the temperature of its outer peripheral surface can be adjusted to a predetermined fixing temperature, based on signals from a temperature detector 74, by a control unit that will hereafter be described. The heat roller 71 has a function of pressing the toner onto the recording sheet under application of heat in cooperation with the pressure roller 72, thereby melting, mixing and pressing the toner images of multiple colors transferred onto the recording sheet and eventually causing it to be thermally fixed onto the recording sheet. In addition, an external heating belt 73 is disposed to heat the heat roller 71 from outside.

Figure 2:
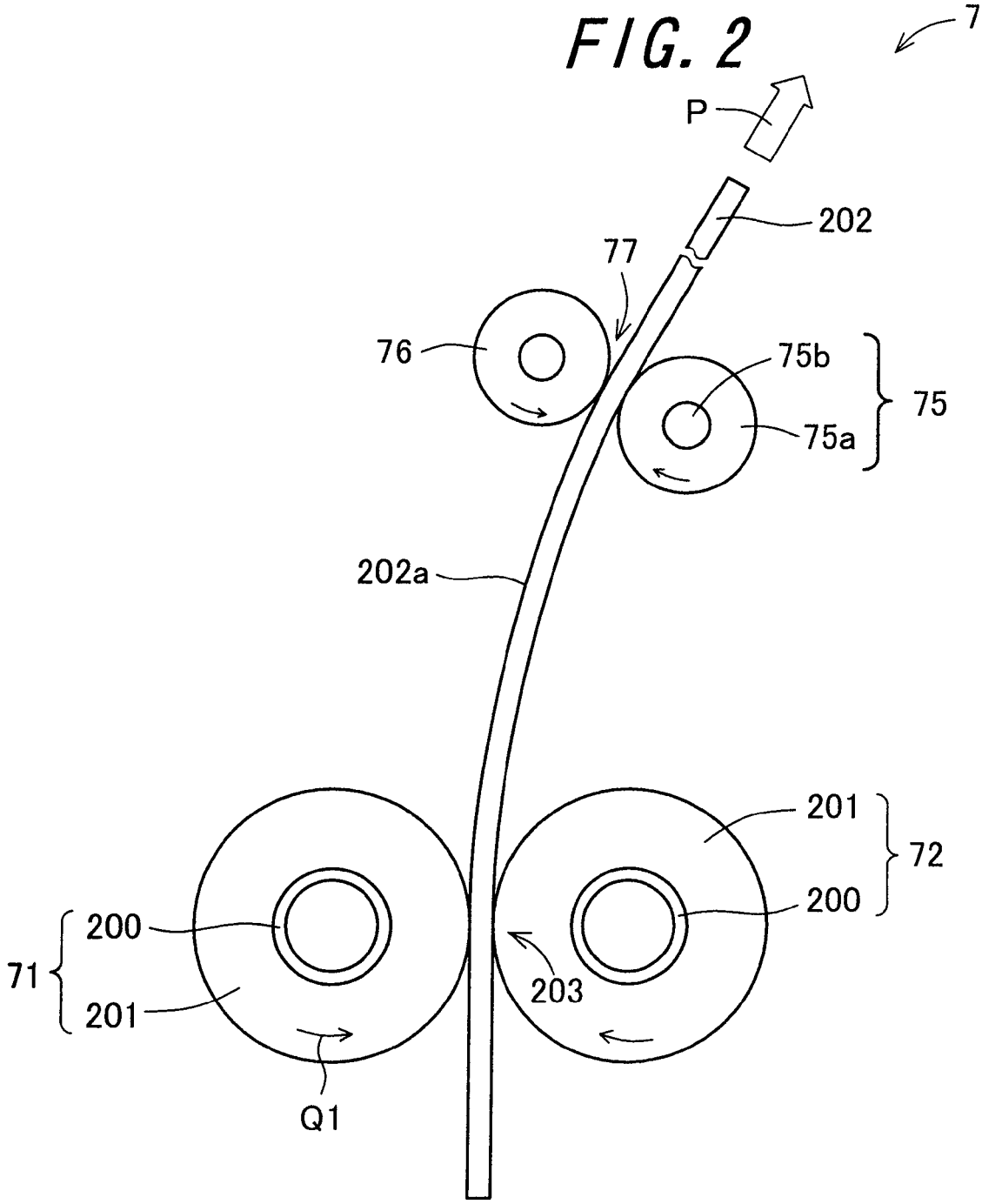
FIG. 2 is a schematic diagram showing a structure of the fixing unit in a simplified manner.

FIG. 2 is a schematic diagram showing the structure of the fixing unit 7 in a simplified manner. In order to simplify an understanding of the invention, in FIG. 2, the external heating belt 73 and the temperature detector 74 shown in FIG. 1 are omitted. The heat roller 71 and the pressure roller 72 are each realized by using an elastic roller. Each of the heat roller 71 and the pressure roller 72 has a cylindrically-shaped roller main body 201 and a cylindrically-shaped rotary shaft 200 which is so formed as to extend from both axial ends of the roller main body 201, the outer diameter of which is smaller than that of the roller main body 201. Of the rotary shaft 200 extending axially on either side of the heat roller 71, the rotary shaft 200 on one axial side is coupled to a gear such as a fixing gear 220 which will hereafter be described, while the rotary shaft 200 on the other axial side is supported by a bearing (not shown). The rotary shafts 200 extending axially on either side of the pressure roller 72 are each supported by bearings (not shown). The roller main body 201, although not shown in the drawing, comprises a cylindrically-shaped core metal, an elastic layer with which the core metal is covered externally in a radial direction thereof, and a release layer with which the elastic layer is covered externally in a radial direction thereof. For example, the core metal is 5 mm in outer diameter size, the elastic layer is 5 mm in thickness size, and the release layer is 30 μm in thickness size. The rotary shaft 200 is formed by pressing both axial ends of the core metal in the draw forming process.

Being constructed of elastic rollers, the heat roller 71 and the pressure roller 72 undergo elastic deformation at their surfaces when brought into pressure-contact with each other. The recording sheet 202 is retained in the nip region 203 where the heat roller 71 and the pressure roller 72 abut against each other, and is conveyed as the heat roller 71 and the pressure roller 72 are rotated. The recording sheet 202 is fed in such a manner that its toner image-bearing surface, namely image surface 202*a* onto which the toner image is transferred by the transfer roller 10 can be brought into contact with the heat roller 71.

In order to convey the recording sheet 202 that has passed through the nip region 203, the fixing unit 7 has a post-fixing roller 75 and a post-fixing driven roller element 76 which moves depending on the rotation of the post-fixing roller 75 that are located downstream of the nip region 203 in a conveyance direction P of the recording sheet 202. The post-fixing roller 75 and the post-fixing driven roller element 76 are rotated with the recording sheet 202 caught in the space between them, whereby the recording sheet 202 can be conveyed. In order to simplify an understanding of the invention, in FIG. 2, the conveyance direction P in which the recording sheet 202 is conveyed after passing through an abutment region 77 where the post-fixing roller 75 and the post-fixing driven roller element 76 abut against each other is illustrated as tilting to the right viewing the drawing.

Figure 3:
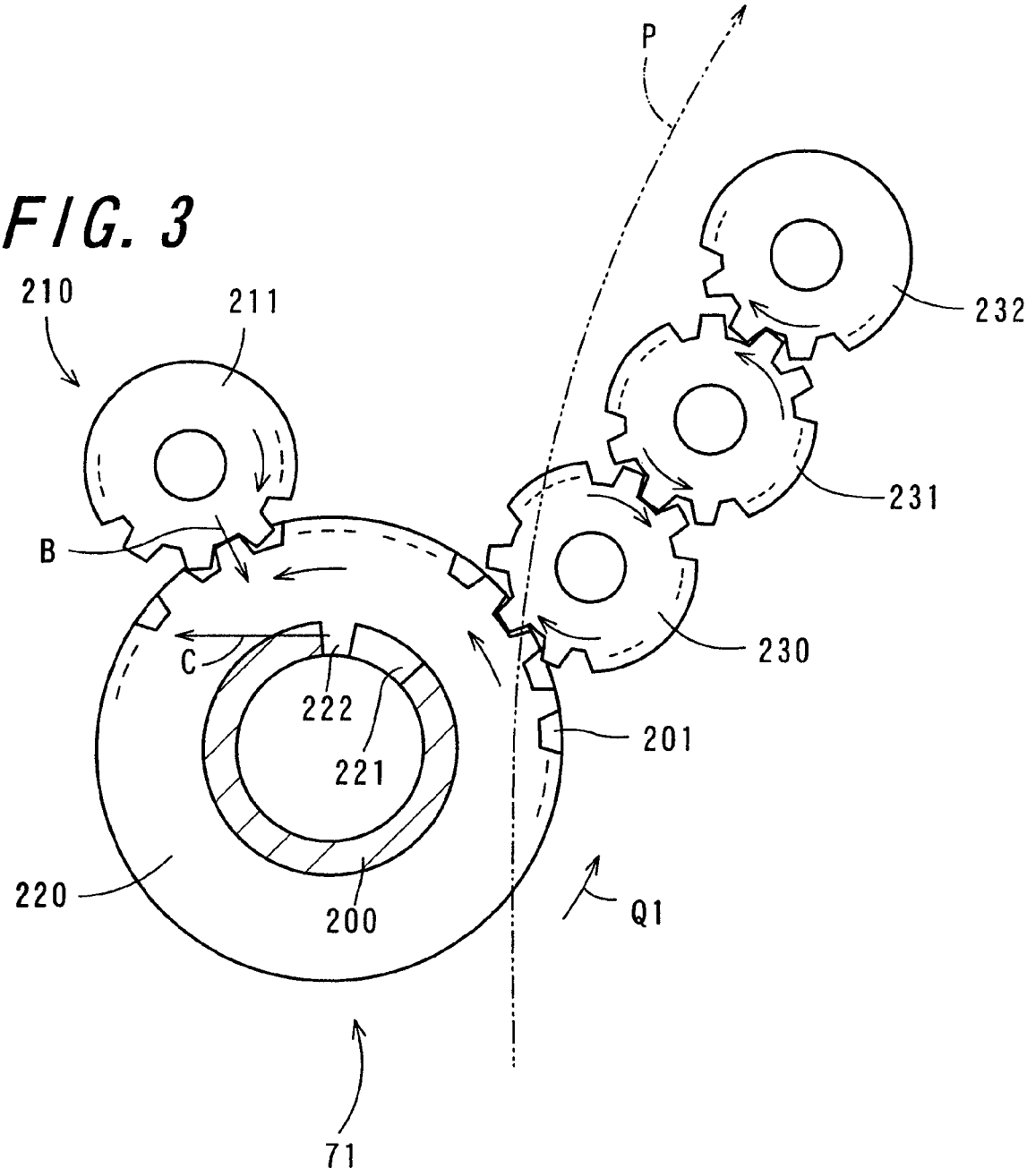
FIG. 3 is a view for explaining a mechanism for transmitting a driving force to a heat roller and to a post-fixing roller.

FIG. 3 is a view for explaining a mechanism for transmitting a driving force to the heat roller 71 and to the post-fixing roller 75. The heat roller 71 and the post-fixing roller 75 are rotatably driven by a driving section 210. To the heat roller 71 is coupled the fixing gear 220 through which the driving force of the driving section 210 is transmitted to the heat roller 71 that will be thereby rotated. The fixing gear 220 is coupled, via a first coupling gear 230 and a second coupling gear 231, to a post-fixing roller driving gear 232 to which also the post-fixing roller 75 is coupled.

With several coupling gears, the fixing gear 220 is coupled to a motor which rotates the paper discharge roller 12*b* shown in FIG. 1, that is one of the conveying rollers, whereby the fixing gear 220 is driven. Stated another way, the driving section 210 contains the motor, although not shown in the drawing, and the coupling gears via which the motor is coupled to the fixing gear 220. Particularly among the coupling gears for coupling the fixing gear 220 to the motor, the coupling gear directly coupled to the fixing gear 220 is a paper discharge roller-side gear 211. In order to rotate the heat roller 71 and the post-fixing roller 75, as shown in FIG. 3, in the driving section 210, the paper discharge roller-side gear 211, which is a driving gear wheel, is rotated by the motor (not shown), thus causing the fixing gear 220 to rotate. The fixing gear 220 is coupled to the rotary shaft 200 of the heat roller 71. In order to simplify an understanding of the invention, in FIG. 3, the rotary shaft 200 of the heat roller 71 is cross-hatched, and part of the teeth of the gears 211, 220, 230, 231, and 232 is omitted.

Figure 4:
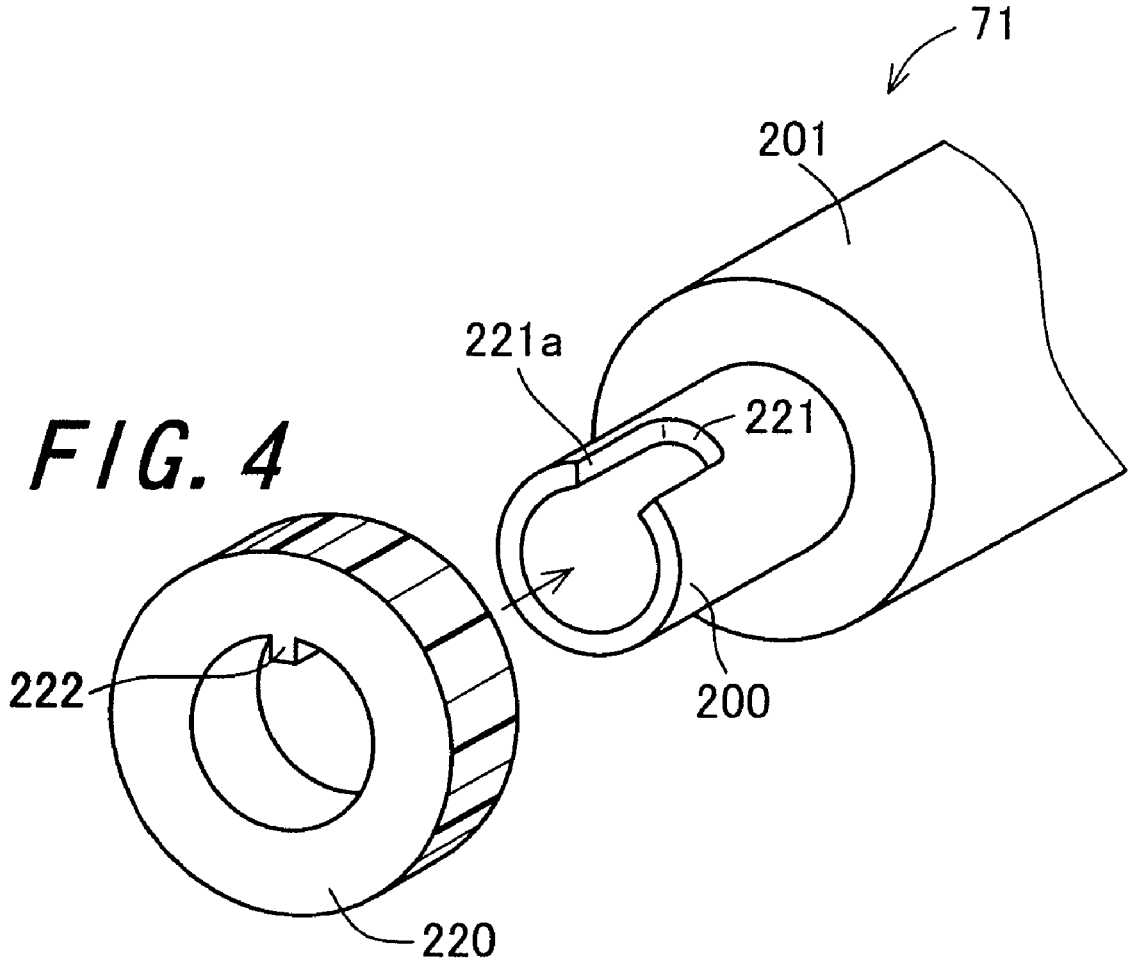
FIG. 4 is an exploded perspective view showing the heat roller and a fixing gear in a disassembled state.
Figure 5:
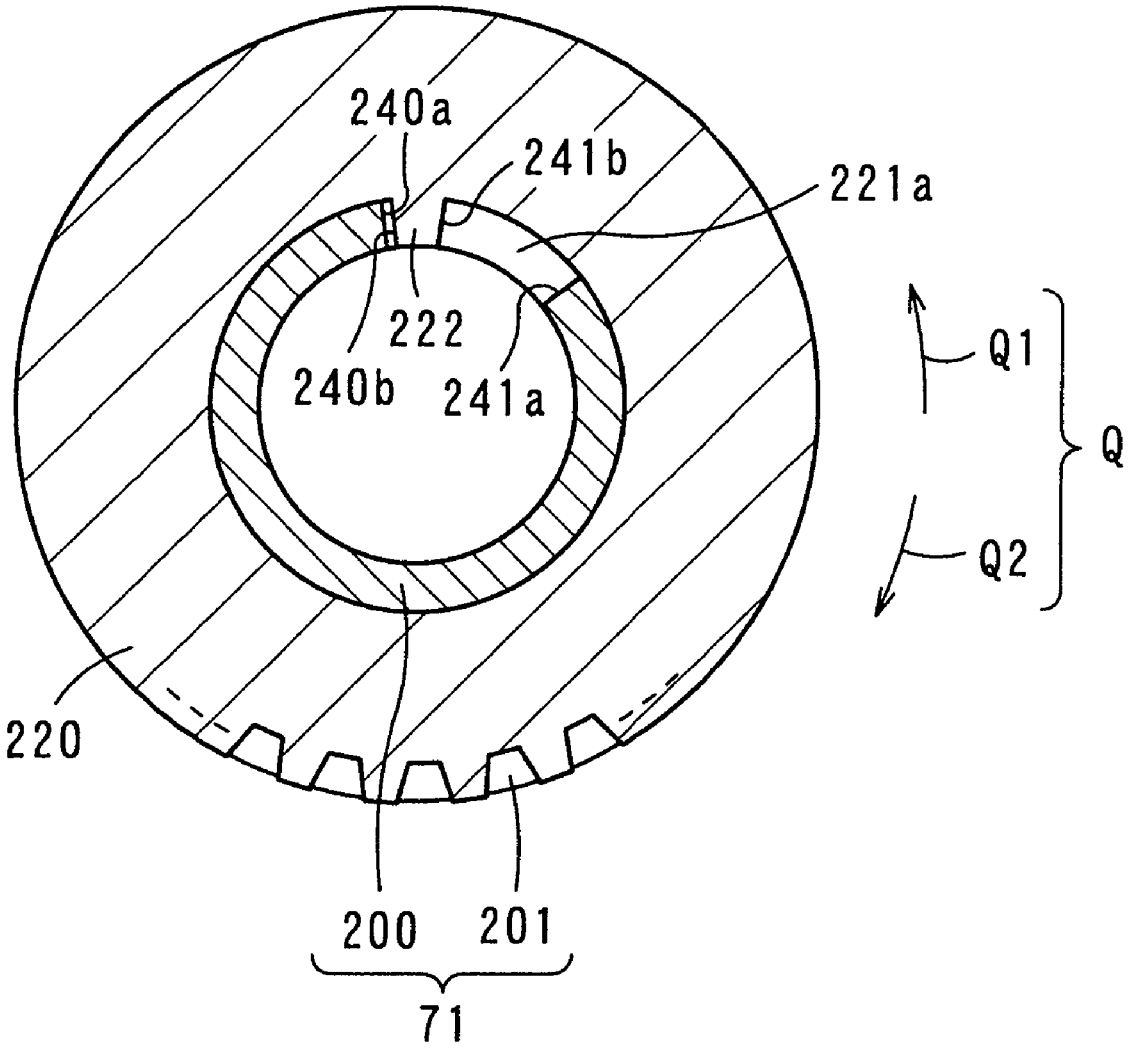
FIG. 5 is a view showing transverse sections of a rotary shaft of the heat roller and the fixing gear mounted on the rotary shaft.

FIG. 4 is an exploded perspective view showing the heat roller 71 and the fixing gear 220 in a disassembled state, and FIG. 5 is a view showing transverse sections of the rotary shaft 200 of the heat roller 71 and the fixing gear 220 mounted on the rotary shaft 200. That is, FIG. 5 is an equivalent of a sectional view of the heat roller 71 taken on a virtual plane perpendicular to an axial direction thereof. In FIG. 5, part of the teeth of the fixing gear 220 is omitted. As described above, the heat roller 71 has the roller main body 201 and the rotary shaft 200 extending from the both axial ends of the roller main body 201. The fixing gear 220 is exteriorly fitted to a free end, that also corresponds to one axial end of the heat roller 71, of the rotary shaft which is hereafter referred to as "one-side rotary shaft" 200 that extends on one axial side. The heat roller 71 and the fixing gear 220 are arranged concentrically. The one-side rotary shaft 200 of the heat roller 71 has a keyway 221. The fixing gear 220 is formed so as to have a substantially circular-ring shaped section, and has teeth on an outer peripheral surface and a key 222, which is to be inserted into the keyway 221, on an inner peripheral surface.

The fixing gear 220 and the heat roller 71 become coupled to each other by inserting the key 222 formed on the fixing gear 220 into the keyway 221 formed in the one-side rotary shaft 200 of the heat roller 71. The roller main body 201 is formed integrally with the one-side rotary shaft 200 and is thus coupled to the fixing gear 220 via the one-side rotary shaft 200. The driving force transmitted to the fixing gear 220 is then transmitted therethrough to the one-side rotary shaft 200 and the rotary main body 201. Under this driving force, the heat roller 71 is driven to rotate about its axis. The pressure roller 72 shown in FIG. 2 is rotated depending on the rotation of the heat roller 71. At this time, the pressure roller 72 is rotated in a direction opposite to the rotational direction of the heat roller 71.

The keyway 221 is designed such that the key 222 is allowed to move along directions Q in which the heat roller 71 is rotated. To be more specific, the keyway 221 is designed such that the key 222 can move relatively to the keyway 221 along the directions Q in which the heat roller 71 is rotated. The keyway 221 is formed by notching the free end of the one-side rotary shaft 200 that corresponds to one axial end of the heat roller 71 so as to extend along the directions Q in which the heat roller 71 is rotated. In other words, the keyway 221 is designed such that the heat roller 71 has a circular arch-shaped section on a virtual plane perpendicular to an axial direction thereof, to be specific, so as to constitute a part of a circular ring. More specifically, the keyway 221 is formed so as to extend along the directions Q in which the heat roller 71 is rotated and along the axis of the heat roller 71.

A keyway portion 221*a* defining the keyway 221, and the key 222 are formed so as to each have a one-side contact region 240*a*, 240*b* which is allowed to contact each other when the heat roller 71 rotates in one direction Q1 relative to the key 222, out of the directions Q in which the heat roller 71 is rotated, and the other-side contact region 241*a*, 241*b* which is allowed to contact each other when the heat roller 71 rotates in the other direction Q2 relative to the key 222, out of the directions Q in which the heat roller 71 is rotated. In the present embodiment, an entire surface region of keyway portion 221*a* in the one direction Q1 relative to the key 222, out of the directions in which the heat roller 71 is rotated, constitutes the one-side contact region 240*a* of the keyway portion 221*a*, while an entire surface region of keyway portion 221*a* in the other direction Q2 relative to the key 222, out of the directions in which the heat roller 71 is rotated, constitutes the other-side contact region 241*a* of the keyway portion 221*a*. Moreover, an entire side region of the key 222 in the one direction Q1 of the directions in which the heat roller 71 is rotated, constitutes the one-side contact region 240*b* of the key 222, while an entire side region of the key 222 in the other direction Q2 of the directions in which the heat roller 71 is rotated, constitutes the other-side contact region 241*a* of the key 222.

The keyway portion 221*a* and the one-side contact region 240*a*, 240*b* of the key 222 constitute, among the contact surfaces between the keyway portion 221*a* and the key 222, the contact surface located downstream in the one direction Q1 of the direction of rotation caused by the fixing gear 220, that is, the contact surface located upstream in the other direction Q2 of the directions of backward rotation which is opposite to the direction of rotation caused by the fixing gear 220. Moreover, the keyway portion 221*a* and the other-side contact region 241*a*, 241*b* of the key 222 constitutes, among the contact surfaces between the keyway portion 221*a* and the key 222, the contact surface located upstream in the one direction Q1 of the direction of rotation, that is, the contact surface located downstream in the other direction Q2 of the directions of rotation.

The key 222 is substantially quadrangular prism-shaped, extending along the axis of the heat roller 71. In more detail, the key 222 is designed such that the heat roller 71 has a circular arch-shaped section on a virtual plane perpendicular to an axial direction thereof, to be specific, such that the key 222, jointly with the keyway portion 221*a*, constitutes a part of a circular ring. In one side of the direction of axis of the heat roller 71 relative to the fixing gear 220, sealing is provided as a gear stopper although not shown in the drawings. This gear stopper allows the fixing gear 220 to be prevented from falling off the rotary shaft 200 of the heat roller 71. Also at the free end (not shown) of rotary shaft extending in the other direction along the axis of the heat roller 71, a sealing is provided. This sealing allows the rotary shaft to be prevented from falling off its bearing.

Returning to FIG. 3, the fixing gear 220 receives driving-force transmission in the direction of the arrow B from the paper discharge roller-side gear 211, whereby the rotary shaft 200 of the heat roller 71 receives driving-force transmission, with the result that the heat roller 71 is rotatably driven. The paper discharge roller-side gear 211 and the fixing roller driving gear 220 are driven to rotate in opposite directions. In this embodiment, the paper discharge roller-side gear 211 is driven to rotate in a clockwise direction, whereas the fixing gear 220 is driven to rotate in a counterclockwise direction. In this way, the heat roller 71 is driven to rotate in the one direction Q1 of the directions of rotation that is a counterclockwise direction. When the fixing gear 220 causes the heat roller 71 to rotate as above, the key 222 and the keyway portion 221*a* come into contact with each other downstream in the one direction Q1 of the directions of rotation that corresponds to the direction in which the heat roller 71 is rotated by the fixing gear 220, with the result that the fixing gear 220 and the heat roller 71 are jointly rotated with the key 222 and the keyway portion 221*a* in contact.

The fixing gear 220 is coupled, via the first coupling gear 230 and the second coupling gear 231, to the post-fixing roller driving gear 232. The first coupling gear 230 engages with the fixing roller driving gear 220, the second coupling gear 231 engages with the first coupling gear 230, and the post-fixing roller driving gear 232 engages with the second coupling gear 231. The post-fixing roller driving gear 232 is coupled to the post-fixing roller 75 shown in FIG. 2 referred to above. The post-fixing roller 75, just like the heat roller 71, comprises a roller main body 75*a* and a rotary shaft 75*b* to which is coupled the post-fixing roller driving gear 232 as in the case of the fixing gear 220.

The post-fixing roller 75 is rotatably driven under the driving force transmitted from the fixing gear 220, through the first coupling gear 230 and the second coupling gear 231, to the post-fixing roller driving gear 232. In this embodiment, since the fixing gear 220 is driven to rotate in a counterclockwise direction, it follows that the post-fixing roller driving gear 232 is driven to rotate in a clockwise direction. Thereby, the post-fixing roller 75 is driven to rotate in a clockwise direction. The post-fixing driven roller element 76, shown in FIG. 2 referred to above, is rotated in a counterclockwise direction depending on the rotation of the post-fixing roller 75.

In a case where the recording sheet 202 is thin, such as so-called thin paper having a basis weight as small as 40 g/m$^2$ or below and a thickness size as small as 0.1 mm or below, for example, as shown in FIG. 3, driving-force transmission is effected in the direction of the arrow B from the paper discharge roller-side gear 211 to the fixing gear 220, and further in the direction of the arrow C from the fixing gear 220 to the rotary shaft 200 of the fixing roller 71. That is, power is transmitted from the paper discharge roller-side gear 211 to the fixing gear 220, and the power is passed onto the rotary shaft 200 and sets upon the heat roller 71 to rotate it. In this way, so long as the direction of power transmission is from the paper discharge roller-side gear 211, through the fixing gear 220, to the rotary shaft 200 of the heat roller 71, the condition of conveyance of the recording sheet 202 will hereafter be referred to as "normal recording-sheet conveyance condition".

On the other hand, in a case where the recording sheet 202 is of the type that has a certain thickness, e.g. a thickness size of 0.3 mm or more, such as gloss paper or heavy paper, the directions of power transmission indicated by the arrows B and C in FIG. 3 may be reversed. Note that "heavy paper" refers to a recording sheet having a thickness size of 0.3 mm or more and that "gloss paper" refers to a recording sheet which is given a texture like a texture of printing paper by applying an agent represented by resin onto a surface of a base sheet represented by paper. The gloss paper has a thickness size of 0.3 mm to 0.5 mm, for example, and therefore belongs to the heavy paper.

Figure 6:
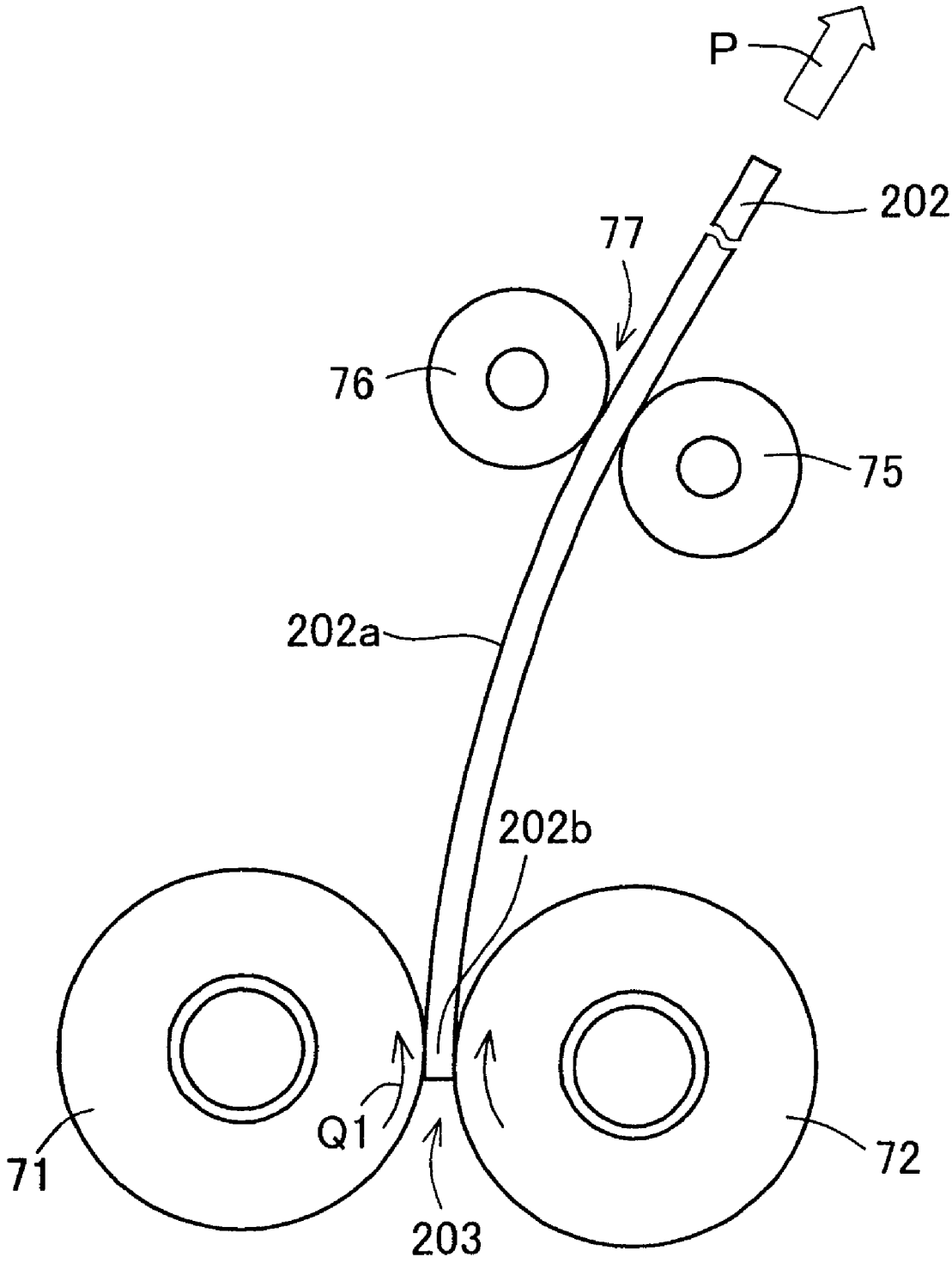
FIG. 6 is a view for explaining a mechanism for reversing a direction of power transmission.

FIG. 6 is a view for explaining a mechanism for reversing the direction of power transmission. As has already been described, since the heat roller 71 and the pressure roller 72 are each an elastic roller, when the recording sheet 202 passes through the nip region 203, the heat roller 71 and the pressure roller 72 undergo elastic deformation owing to the recording sheet 202, in consequence whereof there results a buildup of elastic energy in the rollers 71 and 72. The accumulated elastic energy is released when the recording sheet 202 comes out of the nip region 203; that is, when an upstream-side end 202*b* of the recording sheet 202 in the conveyance direction P passes through the nip region 203, thus causing speeding up of both rollers, namely the heat roller 71 and the pressure roller 72.

Figure 13:
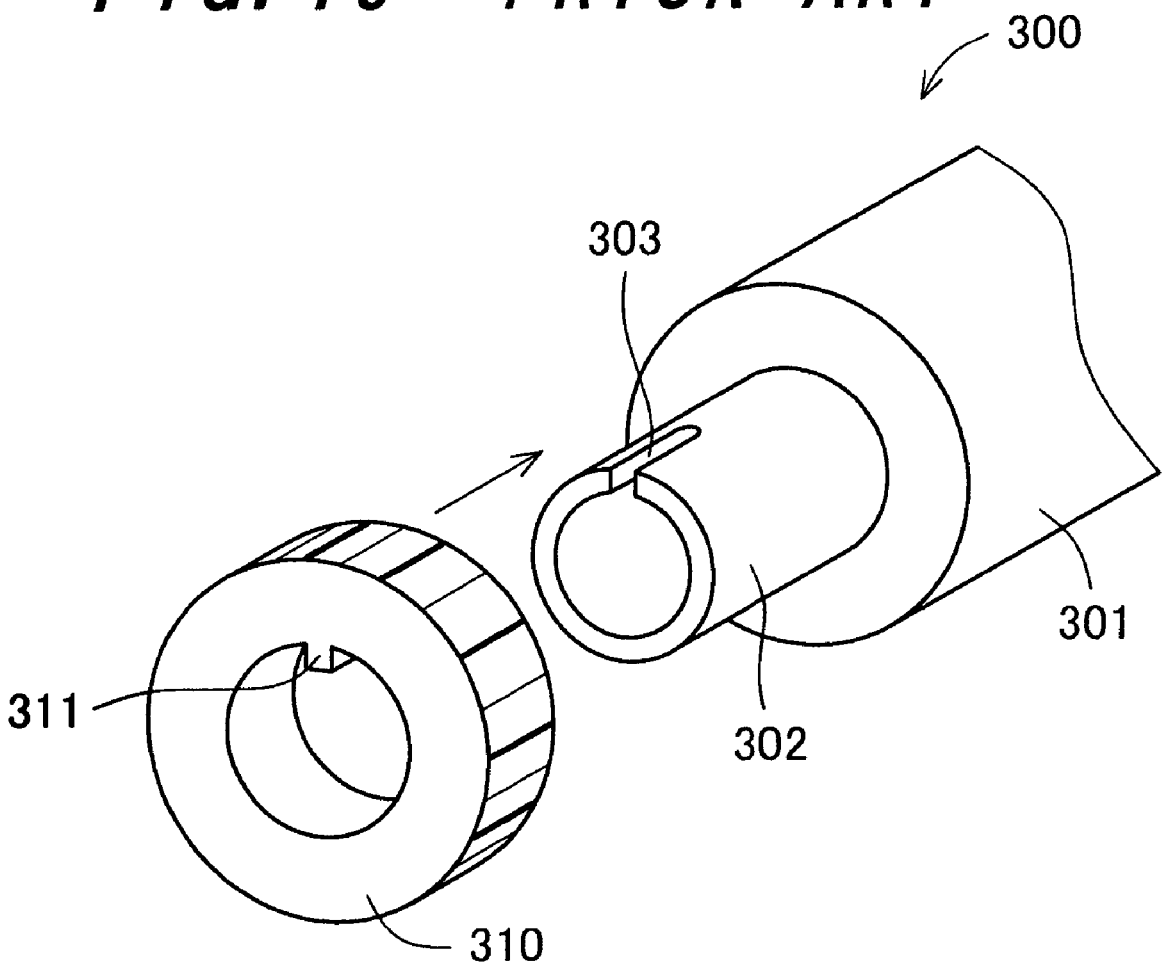
FIG. 13 PRIOR ART
FIG. 13 is an exploded perspective view showing a heat roller in a disassembled state, which is provided in a fixing device according to the related art.
Figure 14:
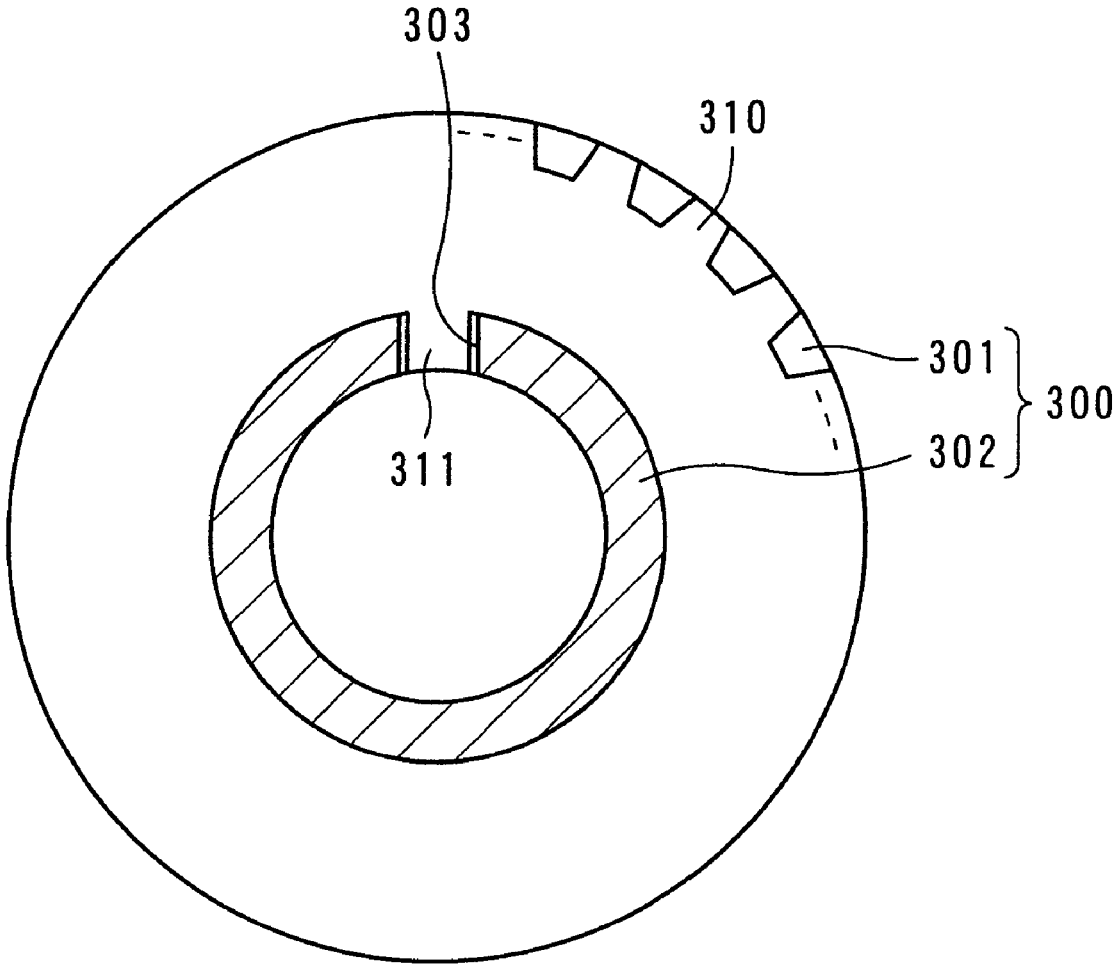
FIG. 14 PRIOR ART
FIG. 14 is a side view of the heat roller, as viewed from one side in an axial direction thereof.
Figure 16:
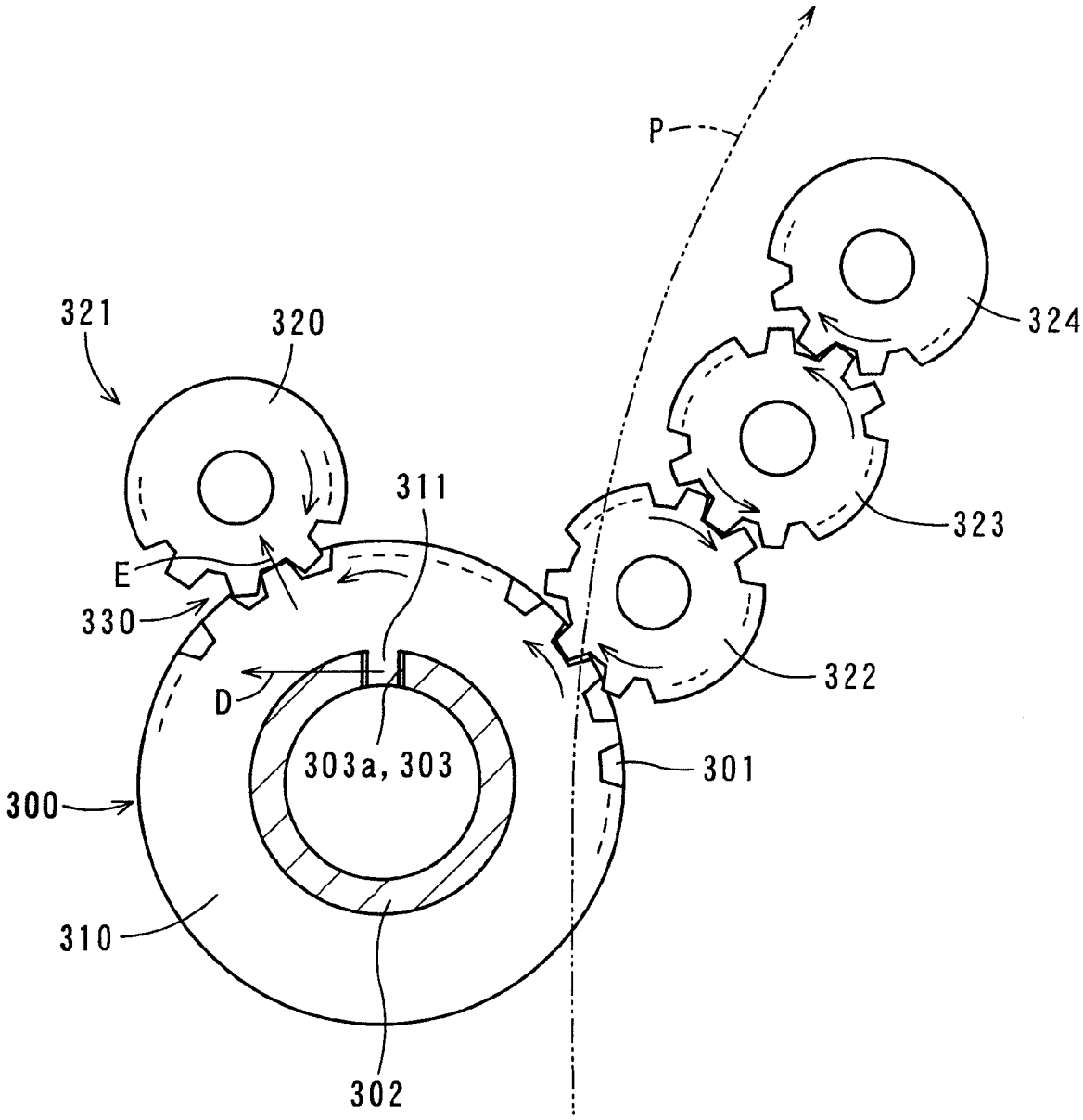
FIG. 16 PRIOR ART
FIG. 16 is a view for explaining a mechanism for reversing a direction of power transmission.

At this time, in the case where the keyway 303 is so formed as to prevent the key 311 from moving along the direction in which the heat roller 300 is rotated as in the case of the above-described related art shown in FIGS. 13 and 14, the drive load on the heat roller 300 is caused to vary. When the heat roller 300 gains speed, as shown in FIG. 16 referred to above, the key 311 of the fixing gear 310 is subjected to a force in, out of the keyway portion of the one-side rotary shaft 302 of the heat roller 71 which defines the keyway 303, a region 303*a* that comes into contact with the key 311 on an upstream side in the direction in which the heat roller 300 is rotated. Under the pressure applied to the key 311, the power transmission direction is reversed, thus effecting power transmission in a direction indicated by an arrow D from the one-side rotary shaft 302 of the heat roller 300 to the fixing gear 310. In consequence, the fixing gear 310 is rotated, and thereby power transmission is effected in a direction indicated by an arrow E from the fixing gear 310 to the paper discharge roller-side gear 320. That is, with the speeding up of the heat roller 300, the power transmission direction is a direction from the heat roller 300, through the fixing gear 310, to the paper discharge roller-side gear 320.

Figure 15:
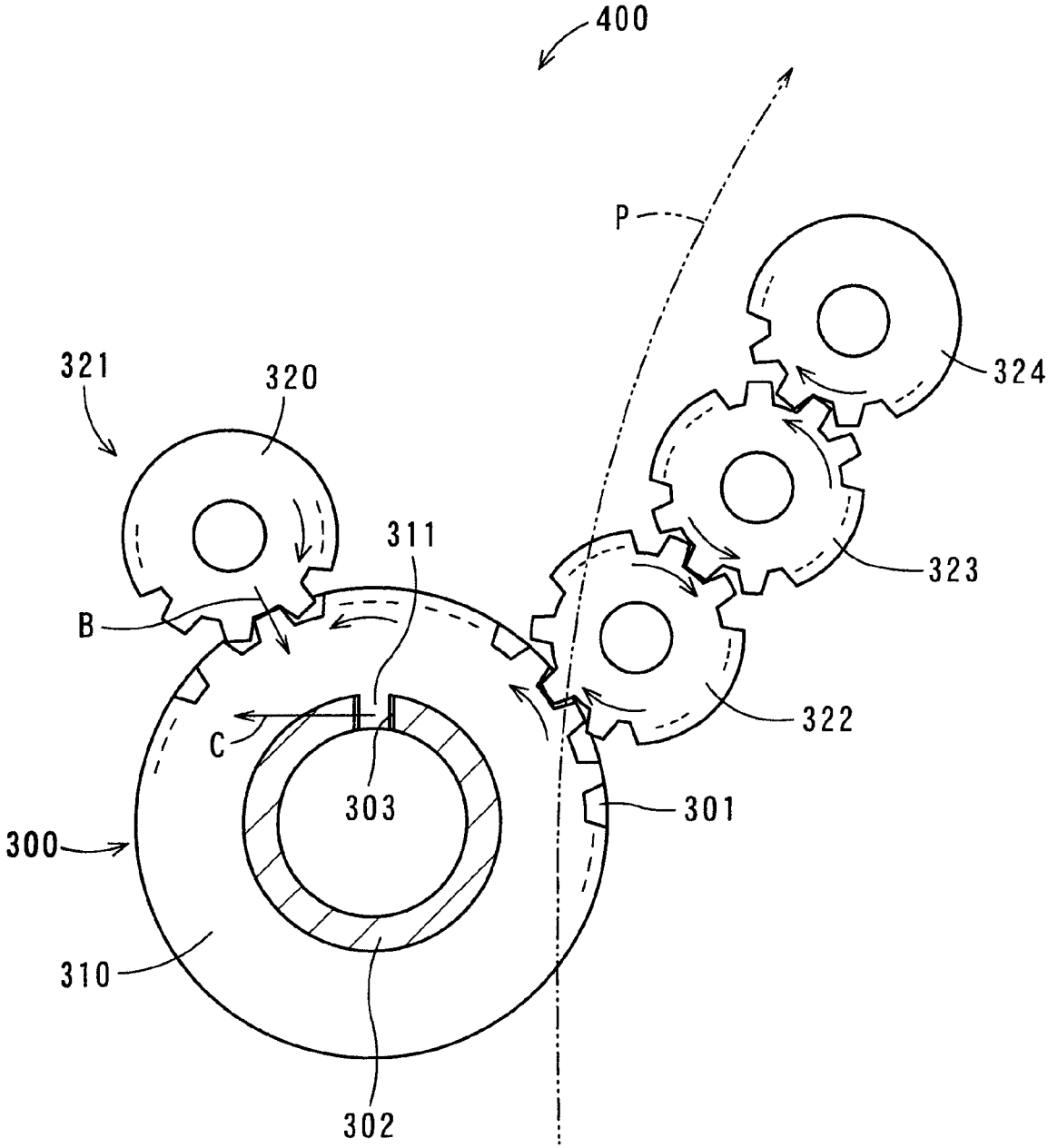
FIG. 15 PRIOR ART
FIG. 15 is a view for explaining a transmission mechanism of a driving force toward the heat roller and the post-fixing roller in accordance with the related art.

The paper discharge roller-side gear 320, which is rotatably driven by a motor, is designed to effect power transmission in a direction reverse to the direction of the arrow E, namely in the power transmission direction of the arrow B shown in FIG. 15 referred to above. Therefore, when the power transmission direction is reversed as above, tooth jumping occurs between the fixing gear 310 and the paper discharge roller-side gear 320, more specifically, in an engagement part indicated by a reference numeral 330 where the fixing gear 310 and the paper discharge roller-side gear 320 engage with each other.

Upon occurring of the tooth jumping, until such time that the normal recording-sheet conveyance condition returns following the completion of speeding up of the heat roller 300 and re-engagement between the paper discharge roller-side gear 320 and the fixing gear 310, as shown in FIG. 6, the recoding sheet 202 is standing still, with its upstream-side end 202*b* in the conveyance direction P of the recoding sheet 202 kept at the nip region 203. That is, the recoding sheet 202 comes to a temporary halt upon the upstream-side end 202*b* thereof in the conveyance direction P of the recoding sheet 202 reaching the nip region 203. During the halting of the recoding sheet 202, the post-fixing driven roller element 76 is kept in contact with the image surface 202*a* of the recoding sheet 202. Inconveniently, the post-fixing driven roller element 76 leaves some impressions on the image borne on the image surface 202*a*.

Hence, in this embodiment, the keyway 221 is so formed as described above that the key 222 is allowed to move along the direction in which the heat roller 71 is rotated; to be specific, that the maximum possible angle $\alpha$ of displacement of the key relative to the keyway 221 is defined as will hereafter be described, whereby it is possible to prevent occurrence of tooth jumping between the fixing gear 220 and the paper discharge roller-side gear 211, and thereby prevent the conveyance of the recording sheet 202 from being impeded.

Figure 7A:
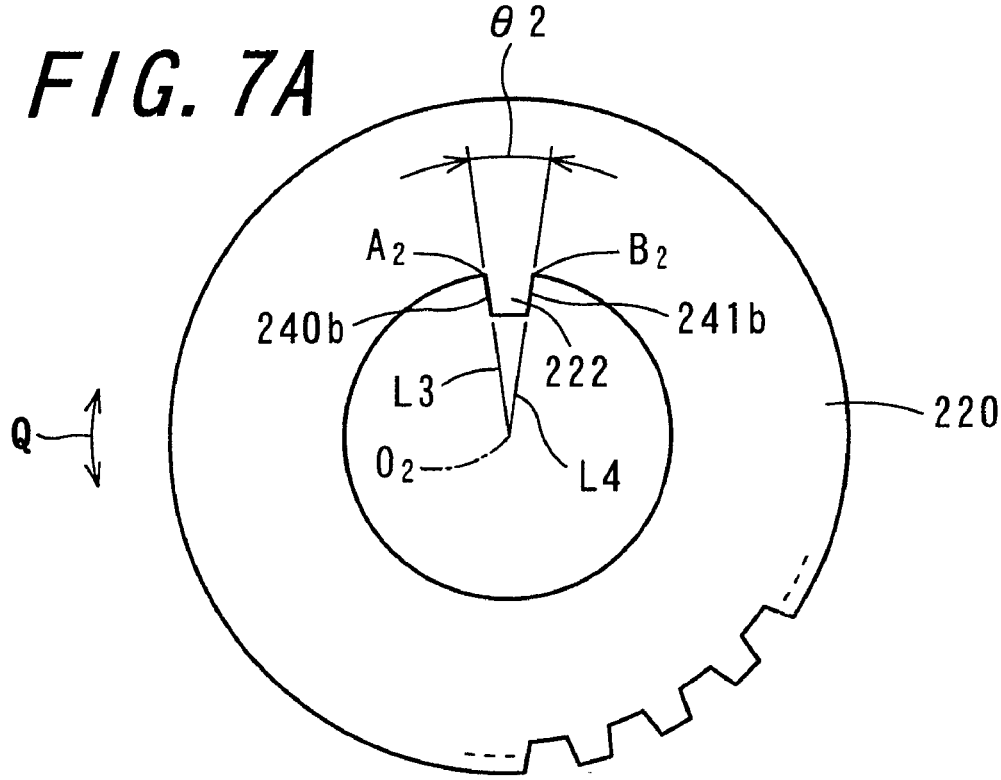
FIG. 7A is a side view of the fixing gear, as viewed from one side in an axial direction thereof.
Figure 7B:
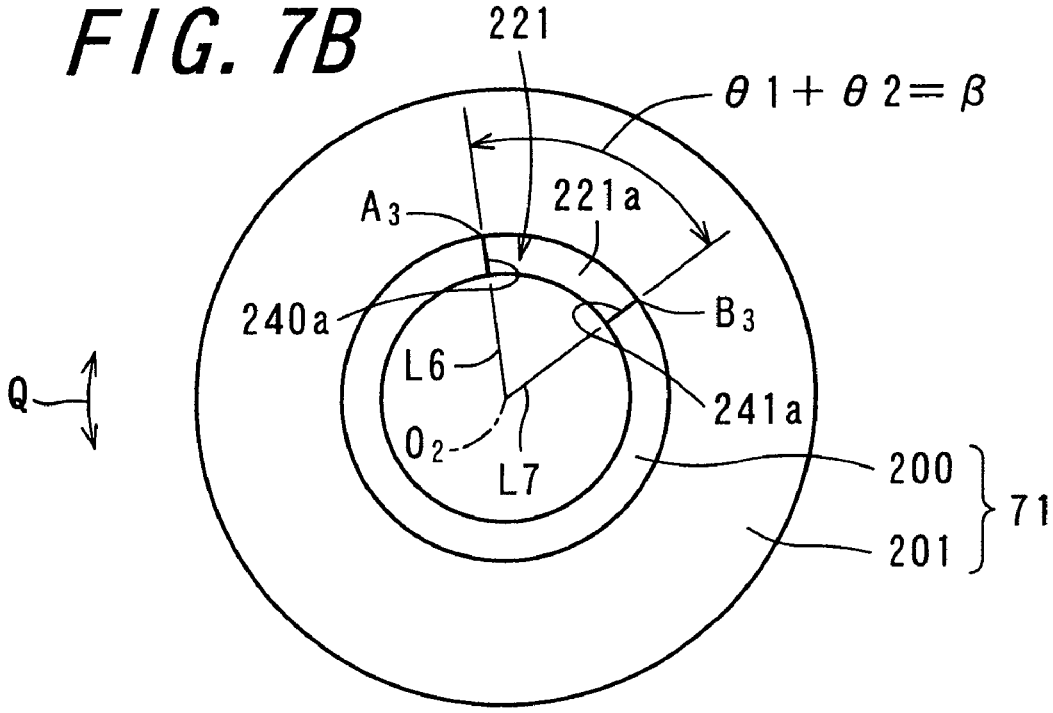
FIG. 7B is a side view of the heat roller, as viewed from one side in an axial direction thereof.
Figure 7C:
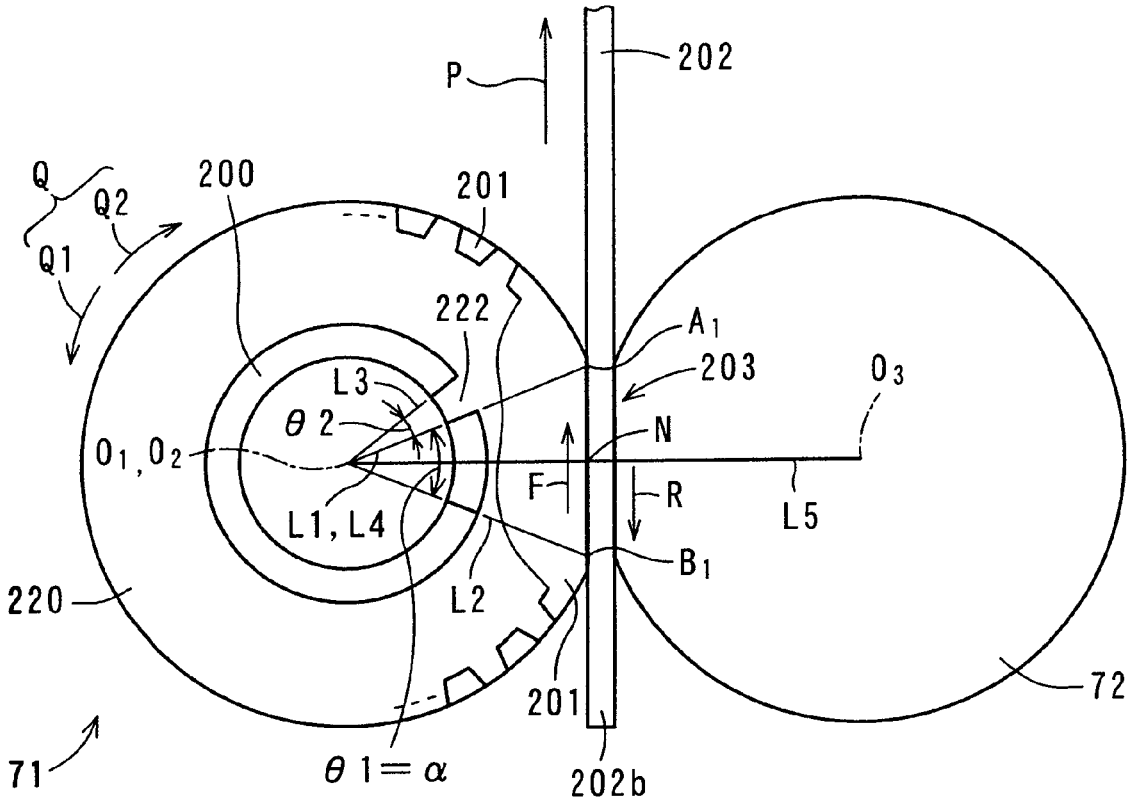
FIG. 7C is a view schematically showing a relation between the heat roller and a recording sheet at the time when the recording sheet is passing through a nip region located between the heat roller and the pressure roller.

FIGS. 7A through 7C are views for explaining a relation between the key 222 and the keyway 221. FIG. 7A is a side view of the fixing gear 220 as viewed from one side in an axial direction thereof, FIG. 7B is a side view of the heat roller 71 as viewed from one side in an axial thereof, and FIG. 7C is a view schematically showing a relation between the heat roller 71 and the recording sheet 202 at the time when the recording sheet 202 is passing through the nip region 203 located between the heat roller 71 and the pressure roller 72. FIG. 7C is a side view of the heat roller 71 and the fixing gear 220 as viewed from one side in an axial direction thereof, in a state that the fixing gear 220 is mounted on the rotary shaft 200 of the heat roller 71. In FIG. 7C, part of the fixing gear 220 is cut out to show the nip region 203. In FIGS. 7A and 7C, part of the teeth of the fixing gear 220 is omitted.

In the present embodiment, referring to the relation between the heat roller 71 and the recording sheet 202 at the time that the recording sheet 202 passes through the nip region 203 as shown in FIG. 7C, a width of the keyway 221; that is, a dimension of the keyway 221 in the direction in which the heat roller 71 is rotated, is determined.

In a cross section perpendicular to an axis of rotation of the heat roller 71, an angle formed by two intersections (hereafter referred to as "sheet roller intersections") $A_1$ and $B_1$ of the heat roller 71 and the recording sheet 202 at the time that the recording sheet 202 is passing through the nip region 203, and a center of rotation $O_1$ of the heat roller 71; namely an angle $\angle A_1O_1B_1$ is specified as $\theta 1$, and an angle made by both ends $A_2$ and $B_2$ of the key 222 of the fixing gear 220 along the direction in which the fixing gear 220 is rotated, and a center of rotation $O_2$ of the fixing gear 220; namely an angle $\angle A_2O_2B_2$ is specified as $\theta 2$. Out of the two sheet roller intersections $A_1$ and $B_1$, the sheet roller intersection $B_1$ located upstream in the conveyance direction P of the recoding sheet 202 is hereafter referred to as an upstream-side sheet roller intersection while the sheet roller intersection $A_1$ located downstream in the conveyance direction P of the recoding sheet 202 is hereafter referred to as a downstream-side sheet roller intersection.

The angle $\angle A_1O_1B_1$ represented by $\theta_1$ corresponds to a nip angle that is an angle on the nip region side 203 out of the angles made by two line segments L1 and L2 which connect the two sheet roller intersections $A_1$ and $B_1$ respectively with an axis of rotation of the heat roller 71. Since the fixing gear 220 and the heat roller 71 are arranged concentrically, the center of rotation $O_2$ of the fixing gear 220 coincides with the center of rotation $O_1$ of the heat roller 71. In addition, since the heat roller 71 is rotated by the fixing gear 202, the direction in which the heat roller 71 is rotated coincides with the direction in which the fixing gear 220 is rotated. Hence it follows that the angle $\angle A_2O_2B_2$ represented by $\theta 2$ corresponds to a key width angle that is an angle on the side including the key 222 out of the angles made by the line segment L3 which connects the one-side contact region 240*b* of the key 222 with the axis of rotation of the heat roller 71, and the line segment L4 which connects the other-side contact region 241*b* of the key 222 with the axis of rotation of the heat roller 71.

The width of the keyway 221 is determined as follows. The elastic energy that has accumulated in the heat roller 71 and the pressure roller 72 starts to be released from when the tail end 202*b* of the recording sheet 202 comes out of the upstream-side sheet roller intersection $B_1$. This causes the heat roller 71 to be subjected to a force F that is oriented in the direction in which the speed of rotation, i.e. the number of revolution, increases; namely along the one direction Q1 of the directions in which the heat roller 71 is rotated by the fixing gear 220. The heat roller 71 and the pressure roller 72 are each deformed to a larger extent at a position closer to a center, namely a center part N between both ends of the nip region 203 in the conveyance direction P of the recoding sheet 202. The force F, which is being generated on the heat roller 71 and oriented in the direction of increasing the number of revolution, is gradually increased toward and peaked at the center N of the nip region 203; to be specific, the part N which includes a line segment L5 which is formed by connecting the center of rotation $O_1$ of the heat roller 71 and a center of rotation $O_3$ of the pressure roller 72.

It is contemplated that the force F being generated in the one direction Q1 of the directions in which the heat roller 71 is rotated, becomes larger than the force R such as a frictional force acting in the other direction Q2 of the directions of rotation opposite to the one direction Q1 of the directions in which the heat roller 71 is rotated by the fixing gear 220, during the period from the time that the tail end 202*b* of the recording sheet 202 passes through the upstream-side sheet roller intersection $B_1$ to the time that the tail end 202*b* of the recording sheet 202 passes through the center N of the nip region 203. Further, it is contemplated that the force F acting in the one direction Q1 of the directions in which the heat roller 71 is rotated by the fixing gear 220, becomes smaller than the force R acting in the other direction Q2 of the directions of rotation opposite to the direction Q1 in which the heat roller 71 is rotated by the fixing gear 220, and the heat roller 71 will then have a negative acceleration, during the period from the time that the tail end 202*b* of the recording sheet 202 passes through the center N of the nip region 203 to the time that the tail end 202*b* of the recording sheet 202 passes through the downstream-side sheet roller intersection $A_1$.

For easy understanding, it is regarded herein that the number of revolution of the heat roller 71 exceeds the number of revolution of the fixing gear 220 at the time that the tail end 202*b* of the recording sheet 202 is passing through the upstream-side sheet roller intersection $B_1$, and the number of revolution of the heat roller 71 is equal to the number of revolution of the fixing gear 220 at the time that the tail end 202*b* of the recording sheet 202 is passing through the downstream-side sheet roller intersection $A_1$.

The keyway is designed to have such a shape that key 222 does not collide even when the heat roller 71 gains speed, by adjusting an angle indicating the width of the keyway 221; namely a keyway width angle β, that is the angle $\angle A_3O_2B_3$ formed by connecting the both ends $A_3$ and $B_3$ of the keyway 222 along the directions Q in which the heat roller 71 is rotated, and the center of rotation $O_2$ of the heating roller 71. It means that the keyway width angle β is selected from such a range that the keyway portion 221*a* does not bump into the key 222 when the heat roller 71 has increased its speed. To be specific, the keyway width angle β is selected at a level equal to or greater than a sum angle (θ1+θ2), which is obtained by adding up the nip angle θ1 and the key width angle θ2. FIG. 7C shows the situation that the keyway width angle β is equal to the sum angle (θ1+θ2). Note that the keyway width angle β represents an angle on the side including the keyway 221 out of the angles made by the line segment L6 which connects the one-side contact region 240*a* of the keyway portion 221*a* with the axis of rotation of the heat roller 71, and the line segment L7 which connects the other-side contact region 241*a* of the keyway portion 221*a* with the axis of rotation of the heat roller 71.

Although the keyway width angle β includes the key width angle θ2, the width of the keyway 221 can be estimated by using the maximum possible angle α of displacement of the key 222 relative to the keyway 221 because the key width angle θ2 is fixed as long as the dimension of the key 222 is fixed. By forming the keyway 221 such that the maximum possible angle α of displacement of the key 222 is equal to or greater than the nip angle θ1, it is possible to prevent tooth jumping between the fixing gear 220 and the paper discharge roller-side gear 211, and thereby prevent the conveyance of the recording sheet 202 from being impeded.

Figure 8:
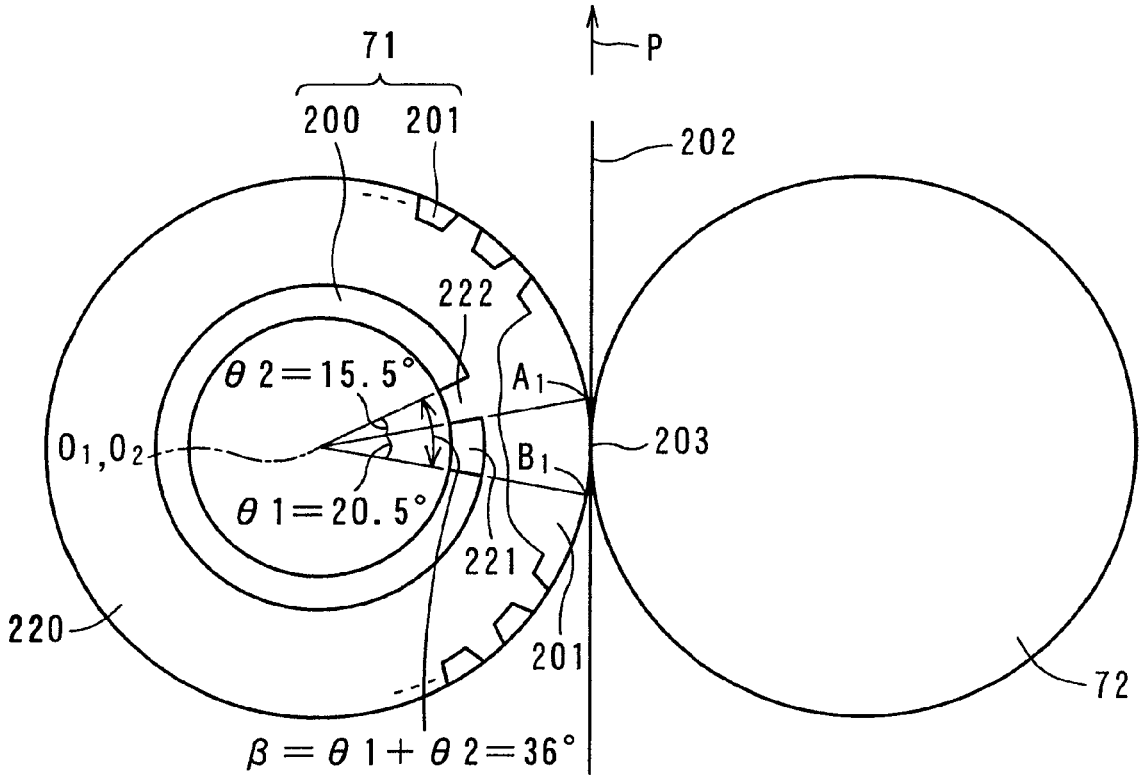
FIG. 8 is a view showing a size example of a key and a keyway.

FIG. 8 is a view showing a size example of the key 222 and the keyway 221. FIG. 8 is, just as in the above-described case of FIG. 7C, a side view of the heat roller 71 and the fixing gear 220 as viewed from one side in an axial direction thereof, in a state that the fixing gear 220 is mounted on the rotary shaft 200 of the heat roller 71, and in FIG. 8, part of the fixing gear 220 is cut out to show the nip region 203. In FIG. 8, part of the teeth of the fixing gear 220 is omitted.

Figure 9A:
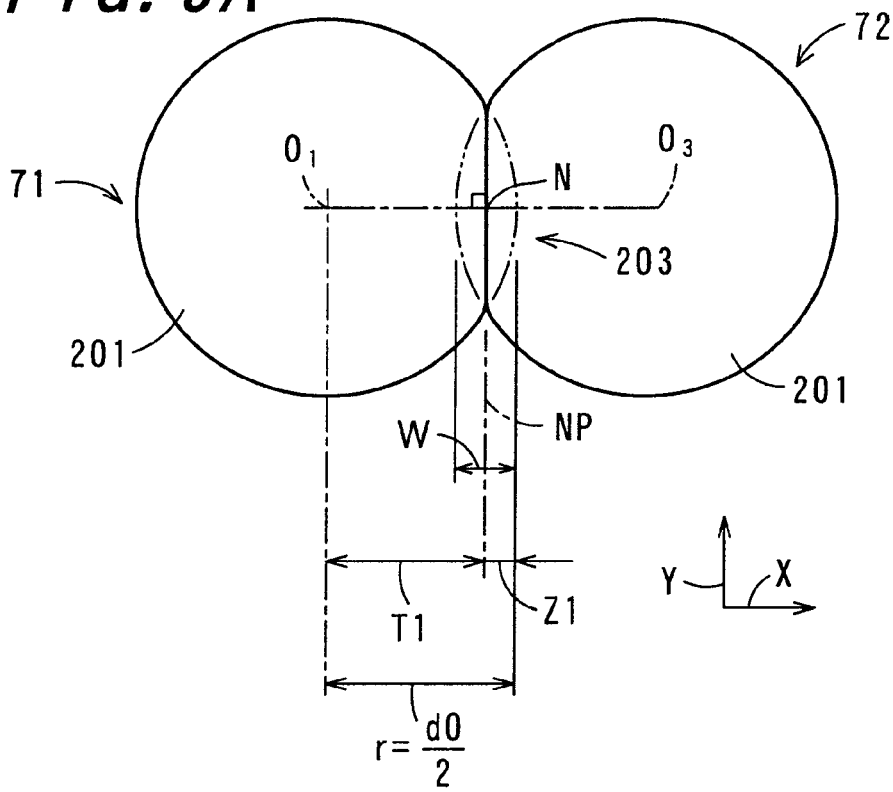
FIGS. 9A and 9B are views for explaining how to determine a nip angle θ1.
Figure 9B:
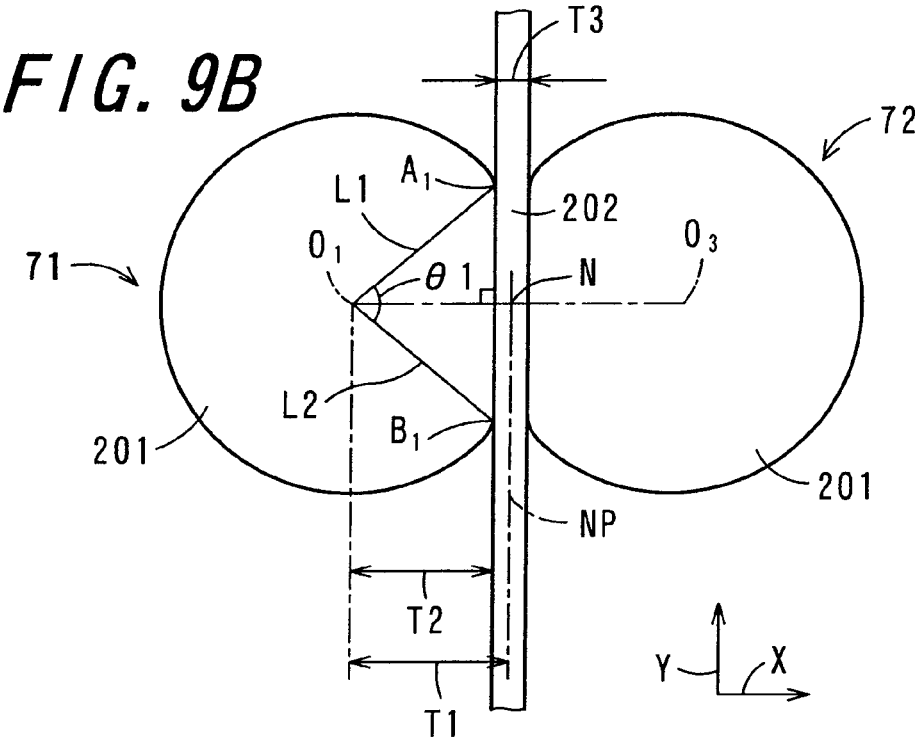

FIGS. 9A and 9B are views for explaining how to determine the nip angle θ1. FIG. 9A is a side view showing the roller main bodies 201 of the heat roller 71 and the pressure roller 72 in a stated that the recording sheet 202 has not yet passed through the nip region 203, and FIG. 9B is a side view showing the roller main bodies 201 of the heat roller 71 and the pressure roller 72 in a state that the recording sheet 202 is passing through the nip region 203. In each of FIGS. 9A and 9B, the rotary shaft 200 is omitted. The heat roller 71 and the pressure roller 72 are brought into pressure-contact with each other and thereby compressed in a direction X (hereafter referred to as "overlapping direction") perpendicular to their axes of rotation, thereby forming the nip region 203. A width of the common part between the heat roller 71 and the pressure roller 72 in the overlapping direction X is hereafter referred to as "width W of the nip region". And the center part N between the both ends of the nip region 203 along the overlapping direction X is referred to as "nip center N", and a plane that includes the nip center N and is parallel to a plane on which the heat roller 71 and the pressure roller 72 makes contact with each other, is referred to as "nip contact plane NP". A direction that is parallel to the contact plane NP and perpendicular to the overlapping direction X, is referred to as "nip contact direction Y".

In the state that the recording sheet 202 has not yet passed through the nip region 203 as shown in FIG. 9A, a distance between the center of rotation $O_1$ of the heat roller 71 and the nip center N in the overlapping direction X; namely a length T1 of the perpendicular line extending vertically from the center of rotation $O_1$ of the heat roller 71 to the nip contact plane NP, is a value obtained by subtracting from the radius r of the heat roller 71 a volume Z1 of the elastic deformation that the heat roller 71 undergoes when brought into pressure-contact with the pressure roller 72, that is half the width W of the nip region 203. The length T1 is thus the value of $\{r-(W/2)\}$.

As shown in FIG. 9B, when the recording sheet 202 is passing through the nip region 203, the heat roller 71 and the pressure roller 72 are further compressed in the overlapping direction X due to the recording sheet 202. The recording sheet 202 passes along the contact direction Y and thus goes past the nip region 203. At this time, a distance between the center of rotation $O_1$ of the heat roller 71 and the recording sheet 202 in the overlapping direction X is denoted by T2 which is obtained by subtracting half thickness dimension T3 of the recording sheet 202 from the above-mentioned distance T1 between the center of rotation $O_1$ of the heat roller 71 and the nip center N. The distance T2 is thus the value of {T1−(T3/2)}.

Accordingly, given that an outer diameter d0 of the roller main body 201 of each of the heat roller 71 and the pressure roller 72 is 50 mm, the width W of the nip region 203 is 0.5 mm, and the thickness dimension T3 of the recording sheet 202 is 0.3 mm, then the nip angle θ1 is, as a concrete figure, 20.5°, which is determined by the following equation (1):

$$\begin{aligned}\theta 1 &= 2\times[180°/\pi\times\cos^{-1}\{(r-W/2-T3/2)/r\}]\\ &= 2\times[180°/\pi\times\cos^{-1}\{(25-0.5/2-0.3/2)/25\}]\\ &\approx 20.5\end{aligned}$$

Returning to FIG. 8, given that the nip angle θ1 is 20.5° as above while the key width angle θ2 is 15.5°, then the sum angle (θ1+θ2), which is obtained by adding up the nip angle θ1 and the key width angle θ2, is 36°. This indicates that the keyway 221 should be formed with the keyway width angle β of 36° or larger. With the keyway width angle β of 36°, the radially-external circular arch section of the keyway 221 is 9.4 mm in dimension. In the example illustrated in FIG. 8, an inner diameter of the fixing gear 220 and an outer diameter of the one-side rotary shaft 200 of the heat roller 71 are each set at 30 mm, and an inner diameter of the one-side rotary shaft 200 is set at 24 mm.

Figure 10:
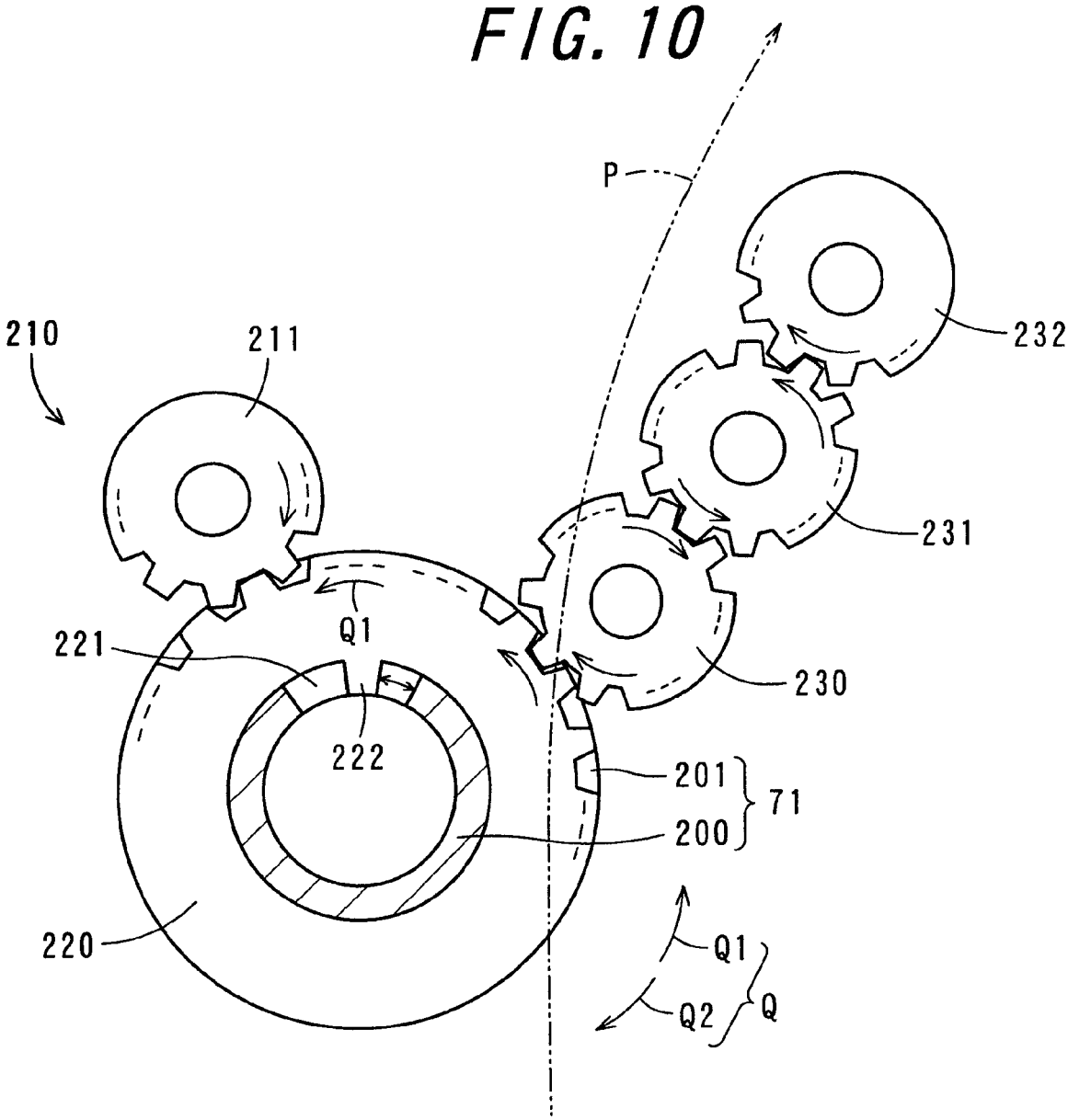
FIG. 10 is a view showing a relation between the fixing gear and the heat roller which is accelerated.

FIG. 10 is a view showing a relation between the fixing gear 220 and the heat roller 71 which is accelerated. In FIG. 10, part of the teeth of the fixing gear 220 is omitted. The heat roller 71 having the keyway 221 defined as above is rotated jointly with the fixing gear 220 as shown in FIG. 3 referred to above, in the normal recording-sheet conveyance condition. When the heat roller 71 gains speed, only the heat roller 71 is accelerated as shown in FIG. 10, which therefore does not affect the fixing gear 220, so that the tooth jumping will not occur between the fixing gear 220 and the paper discharge roller-side gear 211.

As described above, in the present embodiment, the keyway 221 is designed such that the key 222 is allowed to move along the directions Q in which the heat roller 71 is rotated, and as a result, the heat roller 71 and the fixing gear 220 can be uncoupled when the keyway 221 moves in the one direction Q1 of the directions in which the heat roller 71 is rotated by the fixing gear 220; in other words, when the key 222 moves in the other direction Q2 of the directions of rotation opposite to the direction Q1 of rotation caused by the fixing gear 220. When the drive load on the heat roller 71 is caused to vary due to the interaction between the nip region 203 and the recording sheet 202, for example, as shown in FIG. 10 referred to above, when the heat roller 71 receives application of a force other than the driving force transmitted thereto from the driving section 210 via the fixing gear 220, the heat roller 71 is accelerated.

At this time, the key 222 formed in the fixing gear 220 moves along the directions Q in which the heat roller 71 is rotated, with respect to the keyway 221 formed in the heat roller 71; to be more specific, the key 222 moves relatively to the keyway 221 in the other direction Q2 of the directions in which the heat roller 71 is rotated, resulting in uncoupling of the heat roller 71 and the fixing gear 220. This prevents the application of a force from the heat roller 71 onto the fixing gear 220 and thereby prevents the tooth jumping between the fixing gear 220 and the paper discharge roller-side gear 211. To sum up, in the embodiment, the fixing gear 220 can be made so as not to be accelerated when the heat roller 71 is accelerated, whereby it is possible to prevent the tooth jumping between the fixing gear 220 and the paper discharge roller-side gear 211. Accordingly, the conveyance of the recording sheet 202 can be prevented from being impeded, resulting in formation of images without quality deterioration. For example, as in the case of this embodiment, by disposing the post-fixing driven roller element 76 downstream of the nip region 203 in the conveyance direction P of the recording sheet 202, it is possible to protect the recording sheet 202 from impressions made by the post-fixing driven roller element 76.

Especially in a case where the recording medium 202 is heavy paper or gloss paper, having such a large thickness dimension as 0.3 mm, the elastic energy built up in the heat roller 71 and the pressure roller 72 is large, and so is the force F applied in the one direction Q1 of the directions in which the heat roller 71 is rotated by the fixing gear 220. Even in that case, according to the present embodiment, the fixing gear 220 is prevented from receiving a force from the heat roller 71 so that the tooth jumping does not occur between the fixing gear 220 and the paper discharge roller-side gear 211. It is therefore possible to provide the fixing unit 7 that is preferable in the case of using heavy paper or gloss paper as the recording sheet 202.

Further, in this embodiment, the keyway 221 is formed such that the maximum possible angle α of displacement of the key 222 relative to the keyway 221 is equal to or greater than the nip angle θ1. The key 222 is thus allowed to move relatively to the keyway 221 along the directions Q in which the heat roller 71 is rotated, by the nip angle θ1 or larger angle displacement around the axis of rotation of the heat roller 71, in the case where the heat roller 71 receives application of a force other than the driving force transmitted thereto from the fixing gear 220 when the recording sheet 202 is passing through the nip region 203. This makes it possible to prevent the heat roller 71 and the fixing gear 220 from coming into contact with each other at a position to which the key 222 has moved when the speed-up of the heat roller 71 or any other factor caused the key 222 to move relatively to the keyway 211. It is therefore possible to keep the fixing gear 220 more reliably from any force that may be given from the heat roller 71, which thus enables prevention of tooth jumping with higher reliability between the fixing gear 220 and the paper discharge roller-side gear 211.

In other words, the keyway 221 is designed such that the keyway width angle β is equal to or greater than the sum angle (θ1+θ2) consisting of the nip angle θ1 plus the key width angle θ2. The key 222 is thus allowed to move relatively to the keyway 221 along the directions Q in which the heat roller 71 is rotated, by the nip angle θ1 or larger angle displacement around the axis of rotation of the heat roller 71, in the case where the heat roller 71 receives application of a force other than the driving force transmitted thereto from the fixing gear 220 when the recording sheet 202 is passing through the nip region 203. This makes it possible to prevent the heat roller 71 and the fixing gear 220 from coming into contact with each other at a position to which the key 222 has moved when the speed-up of the heat roller 71 or any other factor caused the key 222 to move relatively to the keyway 211. It is therefore possible to keep the fixing gear 220 more reliably from any force that may be given from the heat roller 71, which thus enables prevention of tooth jumping with higher reliability between the fixing gear 220 and the paper discharge roller-side gear 211.

It is contemplated that the elastic energy is released and the heat roller 71 is accelerated from the time the tail end 202*b* of the recording sheet 202 reaches the upstream-side sheet roller intersection $B_1$ until the tail end 202*b* passes by the downstream-side sheet roller intersection $A_1$ as shown in FIG. 7C referred to above. Assuming that the number of revolution of the heat roller 71 becomes equal to the number of revolution of the fixing gear 220 when the tail end 202*b* of the recording sheet 202 is passing by the downstream-side sheet roller intersection $A_1$ as above, the collision of the keyway portion 221*a* with the key 222 caused by the increase in speed of the heat roller 71 will not be prevented reliably unless the key 222 is necessarily kept from bumping into the keyway 221 even if the tail end 202*b* of the recording sheet 202 moves instantly from the upstream-side sheet roller intersection $B_1$ to the downstream-side sheet roller intersection $A_1$.

Assuming that the tail end 202*b* of the recording sheet 202 moves instantly from the upstream-side sheet roller intersection $B_1$ to the downstream-side sheet roller intersection $A_1$, the movement of the recording sheet 202 may accompany an arc motion of the key 222 by the nip angle θ1, at a maximum, around the axis of rotation of the heat roller 71, resulting in that the key 222 moves relatively to the keyway 221. In fact, it takes the tail end 202*b* of the recording sheet 202 some time to move from the upstream-side sheet roller intersection $B_1$ to the downstream-side sheet roller intersection $A_1$, which means that the key 222 keeps away from the keyway portion 221*a* at a constant speed; the key 222 is not brought into contact with the keyway portion 221*a*, while the recording sheet 202 is moving.

Accordingly, as in the case of the embodiment, by forming the keyway 221 such that the maximum possible angle α of displacement of the key 222 is equal to or greater than the nip angle θ1; in other words, such that the keyway width angle β is equal to or greater than the sum angle (θ1+θ2) consisting of the nip angle θ1 plus the key width angle θ2, it is possible to secure margin space between the key 222 and the keyway 221*a*, to be more specific, between the key 222 and the keyway 221*a* on the upstream side in the one direction Q1 of the directions in which the heat roller 71 is rotated by the fixing gear 220. This makes it possible to reliably prevent the heat roller 71 and the fixing gear 220 from coming into contact with each other at a position to which the key 222 has moved when the speed-up of the heat roller 71 caused the key 222 to move relatively to the keyway 221. This means that it is possible to prevent undesirable contact of the keyway portion 221*a* with the key 222 caused by the acceleration of the heat roller 71; to be more specific, possible to prevent so-called inverse contact that the keyway portion 221*a* and the key 222 come into contact with each other on the upstream side in the one direction Q1 of the directions in which the heat roller 71 is rotated by the fixing gear 220.

The keyway width angle β is not particularly restricted in terms of its upper limit. Nevertheless, depending on the keyway width angle β, it may not be possible to provide sufficient strength for the member in which the keyway 221 is formed, i.e., the rotary shaft 200 of the heat roller 71 in the present embodiment. It is therefore preferable that a material, a shape, etc. of the member in which the keyway 221 is formed, be taken into account in selecting the keyway width angle β at such a degree as to provide sufficient strength for the member in which the keyway 221 is formed. As the maximum possible angle α of displacement of the key 222 relative to the keyway 221 is determined by using the keyway width angle β and the key width angle θ2, the upper limit of the maximum possible angle α of displacement is selected just as in the case of that of the keyway width angle β.

The keyway width angle β, which is selected to be equal to or greater then the sum angle (θ1+θ2) consisting of the nip angle θ1 plus the key width angle θ2, will change according to the nip angle θ1 where the key width angle θ2 is constant. The degree of the nip angle θ1 changes depending on materials constituting the heat roller 71 and the pressure roller 72, the thickness dimension of the recording sheet 202, or the like factor. The keyway width angle β is therefore determined based on the key width angle θ2 and the nip angle θ1 that is obtained, for example, as follows: at a step in manufacturing the fixing unit 7, a recording sheet 202 having the largest thickness dimension is selected out of the recording sheets 202 which the fixing unit 7 being manufactured is expected to dealt with, and fed to the nip region 203 between the heat roller 71 and the pressure roller 72, and when the selected recording sheet 202 is passing through the nip region 203, the nip angle θ1 is measured.

Furthermore, according to the present embodiment, the key 222 coupling the fixing gear 220 to the heat roller 71 is formed in an inner peripheral surface of the fixing gear 220, and the keyway 221 into which the key 222 is inserted, is formed in the free end of the one-side rotary shaft 200 of the heat roller 71. This makes it easy to form the keyway 221 and the key 222 such that the key 222 is allowed to move along the directions Q in which the heat roller 71 is rotated, as compared to the case where the keyway is formed in the fixing gear and the key is formed in the heat roller.

Further, according to the present embodiment, the keyway 221 is formed by notching the free end of the one-side rotary shaft 200 of the heat roller 71 so as to extend along the directions Q in which the heat roller 71 is rotated. This makes it easier to form the keyway 221 that allows the key 222 to move along the directions Q in which the heat roller 71 is rotated.

Further, according to the present embodiment, the paper discharge roller-side gear 211 coupled to the fixing gear 220 is coupled to another roller, specifically the paper discharge roller 12*b*, via a coupling gear (not shown), and the driving section 210 is therefore capable of rotating both of the heat roller 71 and the paper discharge roller 12*b*. The driving section 210 for rotating the paper discharge roller 12*b* is therefore capable of functioning also as a driving section for rotating the heat roller 71, which enables to simplify the structure of the fixing unit 7.

Furthermore, according to the present embodiment, the image forming apparatus 100 has the excellent fixing unit 7 in which the fixing gear 220 and the paper discharge roller-side gear 211 are prevented from the tooth jumping therebetween as described above so that the conveyance of the recording sheet 202 is not impeded. It is therefore possible to provide the excellent image forming apparatus 100 which is capable of forming high-quality images without impressions made by rollers such as the post-fixing driven roller element 76.

Figure 11:
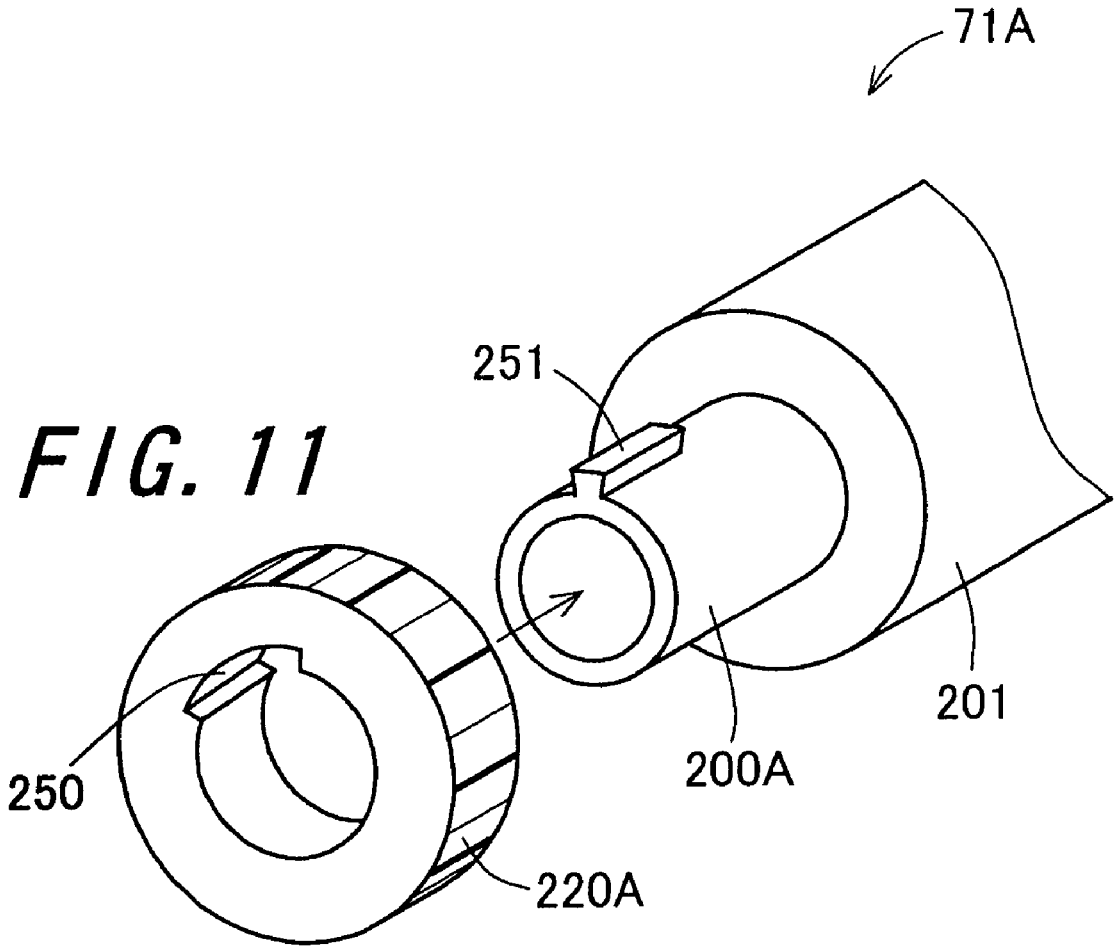
FIG. 11 is a view showing one structural example where the keyway is formed in the fixing gear and where the key is formed in the heat roller.
Figure 12:
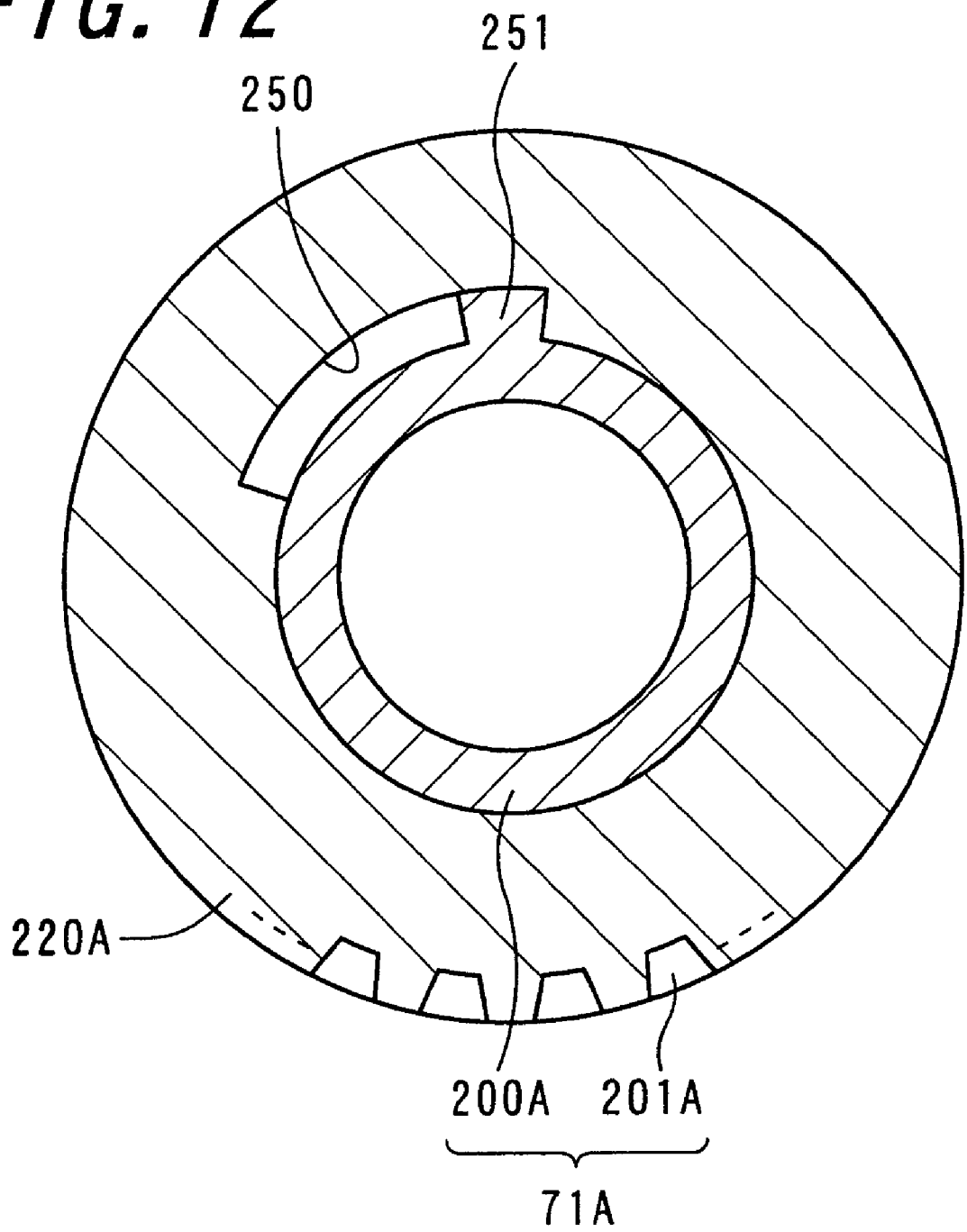
FIG. 12 is a view showing one structural example where the key is formed in the fixing gear and where the key is formed in the heat roller.

Although the key 222 is formed in the fixing gear 220 and the keyway 221 is formed in the heat roller 71 in the above embodiment, it may also be possible to form a keyway in a fixing gear and to form a key in a heat roller. FIGS. 11 and 12 are views each showing one structural example where a keyway 250 is formed in a fixing gear 220A and where a key 251 is formed in a heat roller 71A. FIG. 11 is an exploded perspective view showing the heat roller 71A and the fixing gear 220A in a disassembled state, and FIG. 12 is a view showing transverse sections of a rotary shaft 200A of the heat roller 71A and the fixing gear 220A mounted on the rotary shaft 200A. In FIG. 12, part of teeth of the fixing gear 220A is omitted.

As illustrated in FIGS. 11 and 12, the fixing gear 220A and the heat roller 71A may be coupled to each other by inserting the key 251 formed in an outer peripheral surface of the one-side rotary shaft 200A of the heat roller 71A into the keyway 250 formed in an inner peripheral surface of the fixing gear 220A. Also in this case, the keyway 250 is designed such that the key 251 is allowed to move along the direction in which the heat roller 71 is rotated; to be specific, that the maximum possible angle $\alpha$ of displacement of the key 251 is equal to or greater than the nip angle $\theta 1$. This means that the keyway width angle $\beta$ is selected to be equal to or greater than the sum angle ($\theta 1+\theta 2$) consisting of the nip angle $\theta 1$ plus the key width angle $\theta 2$.

In more detail, the key 251 protrudes externally from the one-side rotary shaft 200A of the heat roller 71A in a radial direction thereof and is formed so as to have a shape of bar which extends along an axis of the heat roller 71A. The keyway 250 is formed by notching the inner peripheral surface of the fixing gear 220A so as to extend in a circumferential direction of the fixing gear 220A along the direction in which the heat roller 71 is rotated. The keyway 250 is formed so as to penetrate the fixing gear 220A in its axial direction from one side to the other side. To be specific, the keyway 250 has an axially uniform shape and is formed so as to have a circular arch-shaped section on a virtual plane perpendicular to an axial direction thereof, to be specific, so as to constitute a part of a circular ring.

While the heat roller 71 and the pressure roller 72 are each an elastic roller in the above embodiment, one of the heat roller 71 and the pressure roller 72 may be a rigid roller in another embodiment of the invention. So long as one of the heat roller 71 and the pressure roller 72 is formed of an elastic roller even if the other is formed of a rigid roller, the pressure-contact of these rollers will cause the surface part of the elastic roller to undergo deformation. In that case, the same effect as achieved in the above embodiment will be produced by forming the keyway so as to allow the key to move along the direction in which the heat roller is rotated; to be specific, so that the maximum possible angle $\alpha$ of displacement of the key becomes the nip angle $\theta 1$ or larger, which means that the keyway width angle $\beta$ becomes equal to or greater than the sum angle ($\theta 1+\theta 2$) consisting of the nip angle $\theta 1$ plus the key width angle $\theta 2$.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device for fixing a toner image formed on a recording sheet, onto the recording sheet, comprising:

a fixing roller adapted to be rotatable about a predetermined axis of rotation;

a pressure roller disposed in pressure-contact with the fixing roller so as to be rotatable depending on a rotation of the fixing roller, the pressure roller holding and conveying a recording sheet on which a toner image is formed in cooperation with the fixing roller in a nip region where the pressure roller and the fixing roller abut against each other;

a fixing gear coupled to the fixing roller, for driving the fixing roller; and a driving section having a driving gear engageable with the fixing gear, for driving the fixing gear by rotating the driving gear, wherein the fixing roller and the fixing gear are arranged concentrically and coupled to each other by inserting a key formed in one of the fixing roller and the fixing gear into a keyway formed in the other of the fixing roller and the fixing gear, the keyway is designed such that the key is allowed to move along a direction in which the fixing roller is rotated, in a cross section of the keyway perpendicular to the axis of rotation of the fixing roller, a maximum possible angle $\alpha$ of displacement of the key relative to the keyway is equal to or greater than a nip angle $\theta 1$ on the nip region side, wherein $\theta 1$ is an angle made by two line segments which are formed by connecting the axis of rotation of the fixing roller with one and the other of two intersections of the fixing roller and the recording sheet being in the passage through the nip region, a keyway portion defining the keyway, and the key are formed so as to each have a one-side contact region which is allowed to contact each other when the fixing roller rotates in a direction relative to the key, and the other-side contact region which is allowed to contact each other when the fixing roller rotates in the other direction relative to the key, and in the cross section of the keyway perpendicular to the axis of rotation of the fixing roller, a keyway width angle $\beta$ on the side including the keyway, wherein $\beta$ is an angle made by a line segment which is formed by connecting the one-side contact region of the keyway portion with the axis of rotation of the fixing roller and a line segment which is formed by connecting the other-side contact region of the keyway portion with the axis of rotation of the fixing roller, and $\beta$ is equal to or greater than a sum angle ($\theta 1+\theta 2$) consisting of the nip angle $\theta 1$ on the nip region side, plus a key width angle $\theta 2$ on the side including the key, wherein $\theta 2$ is an angle made by a line segment which is formed by connecting the one-side contact region of the key with the axis of rotation of the fixing roller and a line segment which is formed by connecting the other-side contact region of the key with the axis of rotation of the fixing roller.

2. The fixing device of claim 1, wherein the key is formed in an inner peripheral surface of the fixing gear, and the keyway is formed in an one axial end of the fixing roller.

3. The fixing device of claim 2, wherein the keyway is formed by notching the one axial end of the fixing roller so as to extend along the direction in which the fixing roller is rotated.

4. The fixing device of claim 1, wherein the driving section has a coupling gear, and the driving gear is coupled to another roller via the coupling gear.

5. The fixing device of claim 1, wherein the recording sheet is heavy paper.

6. The fixing device of claim 1, wherein the recording sheet is gloss paper.

7. An image forming apparatus comprising:

a toner image forming section for forming a toner image on a recording sheet, and the fixing device of claim 1, for fixing the formed toner image onto the recording sheet.

* * * * *